US005761580A

United States Patent [19]

Harada et al.

[11] Patent Number: 5,761,580

[45] Date of Patent: Jun. 2, 1998

[54] PHOTORECEPTOR DRUM DRIVING MECHANISM

[75] Inventors: Yoshikazu Harada, Nara; Yasuji Nakahama, Yamatokoriyama; Toshio Yamanaka, Yao; Hiroshi Naka, Nara, all of Japan

[73] Assignee: Sharp Kabushiki Kaisha, Osaka, Japan

[21] Appl. No.: 721,011

[22] Filed: Sep. 26, 1996

[30] Foreign Application Priority Data

Sep. 26, 1995 [JP] Japan ..... 7-248029
Oct. 6, 1995 [JP] Japan ..... 7-260495

[51] Int. Cl.[6] ..... G03G 15/00

[52] U.S. Cl. ..... 399/167

[58] Field of Search ..... 399/167, 159, 399/116, 117

[56] References Cited

U.S. PATENT DOCUMENTS

| | | | |
|---|---|---|---|
| 5,210,574 | 5/1993 | Kita | 399/117 |
| 5,353,099 | 10/1994 | Tsunoda | 399/167 |
| 5,528,348 | 6/1996 | Miwa et al. | 399/167 |
| 5,579,093 | 11/1996 | Wagner et al. | 399/159 |

FOREIGN PATENT DOCUMENTS

| | | |
|---|---|---|
| 0 731390 | 9/1996 | European Pat. Off. . |
| 58-120265 | 7/1983 | Japan . |
| 61-155863 | 9/1986 | Japan . |
| 1-088561 | 4/1989 | Japan . |
| 2-039971 | 2/1990 | Japan . |
| 4-055043 | 9/1992 | Japan . |
| 4-345173 | 12/1992 | Japan . |
| 6-118851 | 4/1994 | Japan . |

*Primary Examiner*—S. Lee

[57] ABSTRACT

A photoreceptor drum driving mechanism includes a drum drive gear provided at a leading end of a drive shaft, which is in mesh with an internal gear mounted to a photoreceptor drum and a roller coaxially formed with the drive shaft. The mechanism further includes a circular arc surface in contact with the roller in a deflecting direction of the drive shaft. As a result, the drive shaft of the drum drive gear can be prevented from being deformed in a pressure angle direction of the drum drive gear. As this eliminates irregularities in rotations of the photoreceptor drum, a distortion of an image in an image forming process or in a transferring process can be prevented.

22 Claims, 23 Drawing Sheets

PHOTORECEPTOR DRUM DRIVING MECHANISM

FIELD OF THE INVENTION

The present invention relates to a photoreceptor drum driving mechanism for actuating a rotation movement of a photoreceptor drum by an internal gear mounted to an inner circumference of the photoreceptor drum for use in an image forming apparatus provided with a photoreceptor drum such as a copying machine, a printer, etc.

BACKGROUND OF THE INVENTION

As shown in FIG. 22, there are known image forming apparatuses such as copying machines, etc., provided with a cylindrical photoreceptor drum 271. In such image forming apparatus, the surface of the photoreceptor drum 271 is charged by a main charger 272, and is exposed with light emitted from an exposure unit 273. Then, the resulting electrostatic latent image is developed by a developer unit 274, and the developer image is transferred onto a sheet by a transfer charger 275. After the transfer, a developer remaining on the surface of the photoreceptor is removed by a cleaning blade (not shown) of a cleaning unit 276, and the developer image on the sheet is permanently affixed thereto by a fixing unit 277. In the described image forming process, the photoreceptor drum 271 is rotatably driven in one direction by a drive unit.

For the described driving mechanism for the photoreceptor drum, the photoreceptor drum is typically provided with a gear at one end. For simplification of the structure, the external gear system is adopted in most cases. However, with an increasing demand for miniaturization of the apparatuses, the internal gear system is more and more adopted, as this permits members of the apparatus to be positioned in a simple manner.

For example, Japanese Unexamined Utility Model Application No. 155863/1986 (Jitsukaisho 61-155863) discloses a cylindrical photoreceptor holding device.. As shown in FIG. 7 and FIG. 8, the cylindrical photoreceptor holding device includes a plurality of rollers 241 for supporting a photoreceptor drum 240 in a vicinity of both ends of the photoreceptor drum 240, wherein the photoreceptor drum 240 is driven by a gear 244 in mesh with a drive force transmitting member 243 mounted on an inner circumference of the photoreceptor drum 240.

Japanese Unexamined Patent Application No. 120265/1983 (Tokukaisho 58-120265) discloses a drum driving mechanism for a recording device having the arrangement shown in FIG. 9, which permits a shorter drive force transmission path in the drum driving mechanism. In the drum driving mechanism of this citation, an internal gear 252 mounted on an inner circumference of a drum 250 in a vicinity of a center in the lengthwise direction is in mesh with a gear 254 of a motor 253 provided inside the drum 250.

However, the described photoreceptor devices have such a drawback that as one side face perpendicular to the shaft of the photoreceptor drum is an opening, a sufficient strength of the photoreceptor drum cannot be obtained.

In order to counteract the described problem, a photoreceptor drum provided with a flange formed on the closed side face perpendicular to the shaft of the photoreceptor drum is disclosed.

Such driving mechanism for the photoreceptor drum, for example, has the arrangement shown in FIG. 10. That is, a flange 262 including an internal gear section 261 is provided at an end portion of a photoreceptor drum 260 so as to be fitted thereto, and the photoreceptor drum 260 is rotatably driven by a driving system including a driving-use small gear 263. The flange 262 includes an internal gear support section 264 formed on the surface perpendicular to the shaft of the photoreceptor drum 260 so as to support the internal gear section 261 and a bearing member 265 mounted at the center of the internal gear support section 264.

The described arrangement provides a solution to the aforementioned problem by maintaining a sufficient strength of the photoreceptor drum 260 and preventing deviation of shaft center by the bearing member 265.

Here, the positioning precision of the small gear for driving the photoreceptor drum has a great effect on the rotation movement of the photoreceptor drum, i.e., the image quality. Therefore, it is especially important to ensure such positioning precision for driving the photoreceptor drum.

However, in the described driving mechanism with the internal gear, there arises another problem related to the stabilization of a backlash. Here, it is disadvantageous to have a large backlash as abrasion and noise are generated, and the transmission efficiency is lowered, etc. Therefore, a region in a backlash increasing direction should be considered as a dangerous region.

Actually, the direction, in which errors are generated from the regular position of the driving-use external gear was measured respectively with the combination of the external gear and the external gear and the combination of the external gear and the internal gear. The results are summarized in FIG. 11. FIG. 11 shows that when the center of the external gear A or the internal gear B deviates up or down, the center of the external gear C reaches the hatched region where the backlash becomes worse.

When comparing FIG. 11(*a*) with FIG. 11(*b*), it can be seen that when adopting the internal gear B for the given external gear C (drive gear), a hatched region becomes larger than the case of adopting the external gear A. Namely, the combination of the internal gear B with the external gear C results in a larger factor of lowering the positioning precision than the case of adopting the combination of the external gear A and the external gear C, and thus it is required to have a still higher mounting precision of the two gears to compensate for this deficiency.

However, the described arrangement has the following drawback. That is, as shown in FIG. 10, as the driving-use small gear 263 drives the internal gear section 261 by an overhang type shaft, it is difficult to ensure the precision.

In order to drive the rotation movement of the photoreceptor drum by making the drive gear in mesh directly or indirectly with the gear mounted to the photoreceptor drum, a play such as backlash, etc., between gears, is always prepared. Further, in the developing process, the developer roller is rotated at a peripheral velocity of 2 to 2.5 times in the rotation direction of the photoreceptor drum, and the developer roller is pressed onto the photoreceptor drum, which causes a frictional force by the developer roller, thereby presenting the problem of irregularities and deviation in rotations within the play.

Japanese Unexamined Utility Model Application No. 055043/1992 (Jistukaihei 4-055043) discloses a drum brake shown in FIG. 23. That is, a flange 282 with an inner circumference 282*a* is integrally formed at one end of the photoreceptor drum 281, and a brake pad 284 held by an elastic member 283 is made in contact with the inner circumference 282*a* so as to generate a brake force.

Japanese Unexamined Patent Application No. 345173/1992 (Totukaihei 4-345173) discloses a photoreceptor driving device having the arrangement shown in FIG. 24. That is, a brake gear 293 supported via a torque limiter (not shown) by a fixing shaft 294 is made in mesh with a drum gear 291*a* mounted to the end of the photoreceptor drum 291 independently of the drive gear 292 for driving the drum gear 291*a* so as to generate a brake force.

In any of the described conventional arrangements, irregularities and deviation in rotations are prevented by suppressing the looseness due to play by applying the brake force to the photoreceptor drum.

However, in the described drum brake of Japanese Unexamined Utility model Application No. 055043/1992, although the irregularities in rotation for the backlash of the photoreceptor drum 281 can be prevented by the brake force, with an abrasion of the brake pad 284, a deformation of the elastic member 283 becomes small, resulting in a smaller brake force. To compensate for the small brake force, if the contact pressure applied by the elastic member 283 is increased, the initial brake force would become too strong, which causes the deformation on the side of the elastic member 283.

On the other hand, according to the photoreceptor driving device of Japanese Unexamined Patent Application No. 345173/1992, the rotation shaft for the drive gear 292 and the fixing shaft 294 for the brake gear 293 are provided on a peripheral circumference of the photoreceptor drum 291 independently of the rotation shaft for the photoreceptor drum 291. However, as the brake gear 293 is mounted to the fixing shaft 294, the difference between the number of rotations internally applied to the torque limiter and the number of rotations externally applied to the torque limiter is limited, which restricts the available mechanisms for the torque limiter. Furthermore, two shafts are provided on the peripheral circumference of the photoreceptor drum 291 independently of the photoreceptor drum 291. However, as there are provided many members constituting the image forming apparatus on the peripheral circumference of the photoreceptor drum 291 such as the charger, the developer unit, the cleaning unit, etc., it is difficult to ensure a space required for the additional structure. Therefore, it is difficult to meet the recent demand for miniaturization with the described mechanism.

SUMMARY OF THE INVENTION

An object of the present invention is to provide a photoreceptor drum driving mechanism which eliminates the looseness of the photoreceptor drum due to a backlash to prevent irregularities in rotations.

In order to achieve the above object, the first photoreceptor drum driving mechanism of the present invention is characterized by including:

a photoreceptor drum provided with an internal drum gear;

a drum drive gear supported by an overhang type shaft, the drum drive gear being in mesh with the internal drum gear;

a driving unit for driving the photoreceptor drum by rotating the drum drive gear; and a roller circumscribed on a rolling surface formed in a concentric circle with a rotation shaft of the photoreceptor drum, the roller being coaxially formed with a rotation shaft of the drum drive gear.

According to the described arrangement, when the drum drive gear is in mesh with the internal drum gear to transmit the drive force, even if a deviation of the rotation shaft of the drum drive gear occurs, the drum drive gear would not be deflected by the roller and the rolling surface which are coaxially formed with the drum drive gear. As this prevents a backlash between the drum drive gear and the internal drum gear in excess of a predetermined threshold value, irregularities in rotations of the photoreceptor drum hardly occur. As a result, the photoreceptor drum can be driven with high precision, and the distorted image due to irregular rotations of the photoreceptor drum can be prevented.

The second photoreceptor drum driving mechanism is arranged so as to include:

a photoreceptor drum provided with an internal drum gear;

a drum drive gear coaxially formed with a rotation shaft of the photoreceptor drum;

a plurality of intermediate gears being supported by an overhang type shaft, the intermediate gears being provided at equal intervals around the drum drive gear, the intermediate gears being in mesh with the internal drum gear and the drum drive gear; and a drive unit for driving the photoreceptor drum by rotating the drum drive gear.

According to the described arrangement, as the resultant force of the forces in the pressure angle direction generated from the plurality of intermediate gears placed at equal intervals are balanced each other, and the drive force is dispersed and transmitted to the internal drum gear from the drum drive gear. As a result, the load of each intermediate gear is reduced, thereby suppressing the distortion and abrasion of the teeth.

The second photoreceptor drum driving mechanism may further include a roller circumscribed on a rolling surface formed on an inner circumference of the photoreceptor drum, the roller being coaxially formed with the plurality of intermediate gears.

According to the described arrangement, as the roller permits the position of the photoreceptor drum to be maintained constant, a desirable backlash between each intermediate gear and the drum drive gear can be maintained. Further, as this prevents the deviation of the axis of the photoreceptor drum, distorted image due to irregularities in rotation of the photoreceptor drum can be prevented.

The third photoreceptor drum driving mechanism is arranged so as to include:

a photoreceptor drum provided with a drum gear unit;

a drum drive gear in mesh with the drum gear unit;

a drive unit for driving the photoreceptor drum by rotating the drum drive gear; and a brake gear in mesh with the drum gear unit, for controlling play between the drum gear unit and the drum drive gear by applying a braking force on the photoreceptor drum, the brake gear being provided on a rotation shaft of the brake gear via a torque limiter, wherein a combination of gears and a gear ratio are set in such a manner that a number of rotations of the brake gear being transmitted from the drum gear unit to the brake gear is different from a number of rotations being transmitted from the drum drive gear to the torque limiter via the rotation shaft of the brake gear.

The described arrangement offers a larger degree of freedom in the direction of differential rotations applied to the torque limiter and speed setting. Therefore, an improved adoptability to be suited to the respective characteristics of the torque limiter can be achieved. As a result, a larger permissible range of the characteristics of the torque limiter can be achieved, thereby achieving, for example, such an effect that the torque limiter can be selected with ease to be suited for respective purposes in consideration of differential rotation range, durability, cost, etc.

The third photoreceptor drum driving mechanism may be arranged such that the rotation shaft of the brake gear coincides with the rotation shaft of the drum drive gear.

According to the described arrangement, both the drive force and the brake force can be applied to the photoreceptor drum by means of a sole shaft, and the irregularities or deviation in rotations of the photoreceptor drum can be prevented. As a result, in the image forming apparatus, the irregularities and deviation in rotations of the photoreceptor drum can be prevented without requiring a larger space for the installation of other members around the circumference of the photoreceptor drum.

The fourth photoreceptor drum driving mechanism is characterized by including:

a photoreceptor drum provided with an internal drum gear and a braking surface;

a drum drive gear in mesh with the internal drum gear;

a drive unit for driving the photoreceptor drum by rotating the drum drive gear; and a brake force application member in contact with the braking surface by a reaction force exerted between the internal drum gear and the drum drive gear when driving, the brake force application member being provided on the drive shaft of the drum drive gear.

According to the described arrangement, when the photoreceptor drum is being driven, the brake force can be applied thereto with a simple structure, and this permits irregularities and deviation in rotations to be prevented. Additionally, as the reaction force can be suppressed by the brake force application member, a desirable clearance between the gears can be ensured, thereby maintaining desirable rotations of the photoreceptor drum.

Furthermore, the fourth photoreceptor drum driving mechanism may be arranged so as to include:

a torque limiter having a differential toque which is smaller than a friction force exerted between the brake force application member and the braking surface by the reaction force, wherein the braking surface is circularly formed so as to integrally rotate with the photoreceptor drum around a bearing of the photoreceptor drum, the brake force application member is coaxially formed in a concentric circle with the drive shaft of the drum drive gear via the torque limiter, and a circumferential portion of the brake force application member is in contact with the braking surface.

According to the described arrangement, in a normal operation, the brake force application member does not slide, and thus, the abrasion of the brake force application member can be significantly reduced. As a result, a predetermined function of maintaining a desirable clearance between gears and applying a brake force can be ensured.

The novel features which are considered as characteristic of the invention are set forth in particular in the appended claims. The improved treatment method, as well as the construction and mode of operation of the improved treatment apparatus, will, however, be best understood upon perusal of the following detailed description of certain specific embodiments when read in conjunction with the accompanying drawings.

BRIEF DESCRIPTION OF THE DRAWINGS

FIG. 5(*b*) is an arrangement drawing showing a relative position of the gears in the photoreceptor drum driving mechanism of FIG. 5(*a*).

FIG. 6(*b*) is an arrangement drawing showing a relative position of the gears in the photoreceptor drum driving mechanism of FIG. 6(*a*).

FIG. 11(*b*) is an explanatory view showing the engagement in the case where the driven side is the internal gear.

FIG. 17(*b*) is an explanatory view of the case where the relative position of FIG. 17(*a*) satisfies the condition of $m_1(z_1-2.5)\leqq m_2(Z_2+2)$.

FIG. 23(*b*) is a cross-sectional view taken on line A—A of FIG. 23(*a*).

FIG. 24(*b*) is a cross-sectional view schematically showing the brake mechanism.

DESCRIPTION OF THE EMBODIMENTS

Figure 12:
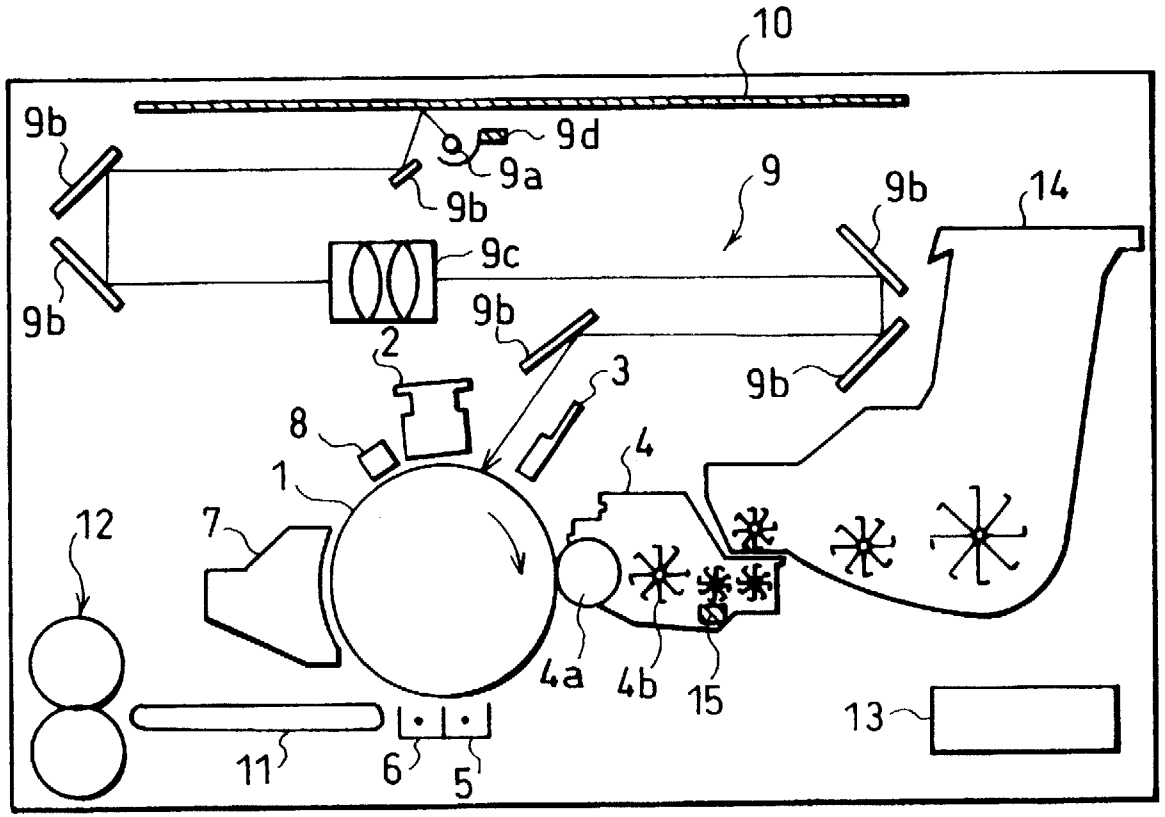
FIG. 12 is a cross-sectional view schematically showing a structure of a copying machine to which the photoreceptor drum driving mechanism of the present invention is applicable.

In order to explain embodiments of a photoreceptor drum driving mechanism in accordance with the present invention, an example of a copying machine adopting the photoreceptor drum driving mechanism will be explained in reference to FIG. 12.

The copying machine has a cylindrical photoreceptor drum 1 in the inside. Along the circumference of the photoreceptor drum 1, provided are a main charger 2, a blank lamp 3, a developer unit 4, a transfer charger 5, a separation charger 6, a cleaning unit 7 and a removing lamp 8.

Further, above the photoreceptor drum 1, provided is an exposure unit 9. These members constitute the process elements for use in the image forming process. The exposure unit 9 includes an exposure lamp 9*a*, a plurality of mirrors 9*b*, a lens 9*c* and an automatic exposure sensor 9*d*. On the exposure unit 9, provided is a document platen 10 made of a transparent hard glass. The copying machine also includes a transportation belt 11, a fixing unit 12 and a control unit 13.

In the described copying machine, an image is formed in the following manner. A sheet placed on the document platen 10 is exposed by the exposure lamp 9*a* of the exposure unit 9, and the light reflected therefrom is projected onto the photoreceptor drum 1 through the plurality of mirrors 9*b* and the lens 9*c*. In this state, the photoreceptor drum 1 is charged to a predetermined potential by a corona discharge from the main charger 2, and is rotated at a constant velocity in the direction shown by an arrow. As a result, in the photoreceptor drum 1, the potential of the region irradiated with the reflected light drops, i.e., the photoreceptor drum 1 is exposed, thereby forming an electrostatic latent image on the surface of the photoreceptor drum 1. Then, charges in the non-image forming region of the photoreceptor drum 1 are removed by projecting thereon light from the blank lamp 3 in accordance with the sheet size.

The electrostatic latent image is developed by the developer (toner) supplied from a developer roller 4*a* of the developer unit 4, i.e., the toner to form an toner image. In this state, the toner is supplied to the developer unit 4 from a toner hopper 14. The described supply of toner is performed based on the result of detection by a toner concentration sensor 15 mounted to the developer unit 4. The toner is stirred with a stirring roller 4*b* to be charged to an opposite polarity to the charged electric potential of the photoreceptor drum 1.

The toner image is transferred onto a sheet (not shown) supplied between the photoreceptor drum 1 and the transfer charger 5 by the transfer charger 5 to be a visible image. Here, an attractive force is exerted between the sheet after the transfer and the photoreceptor drum 1. Thus, by applying an AC corona onto the sheet by the separation charger 6 so as to reduce the potential of the sheet to the same potential as the surface of the photoreceptor drum 1, the attractive force is eliminated, thereby separating the sheet from the surface of the photoreceptor drum 1 by a separation piece 18 (see FIG. 13) using the rigidity of the sheet. Then, the sheet is carried on the transportation belt 11 to the fixing unit 12, where the toner image is made permanent on the sheet.

After the toner image has been transferred, the residual toner remaining on the surface of the photoreceptor drum 1 is collected by the cleaning unit 7, and the residual electric potential of the photoreceptor drum 1 is removed by reducing the electrical resistance of a photoconductive layer by projecting thereto a light emitted from the remover lamp 8.

Figure 13:
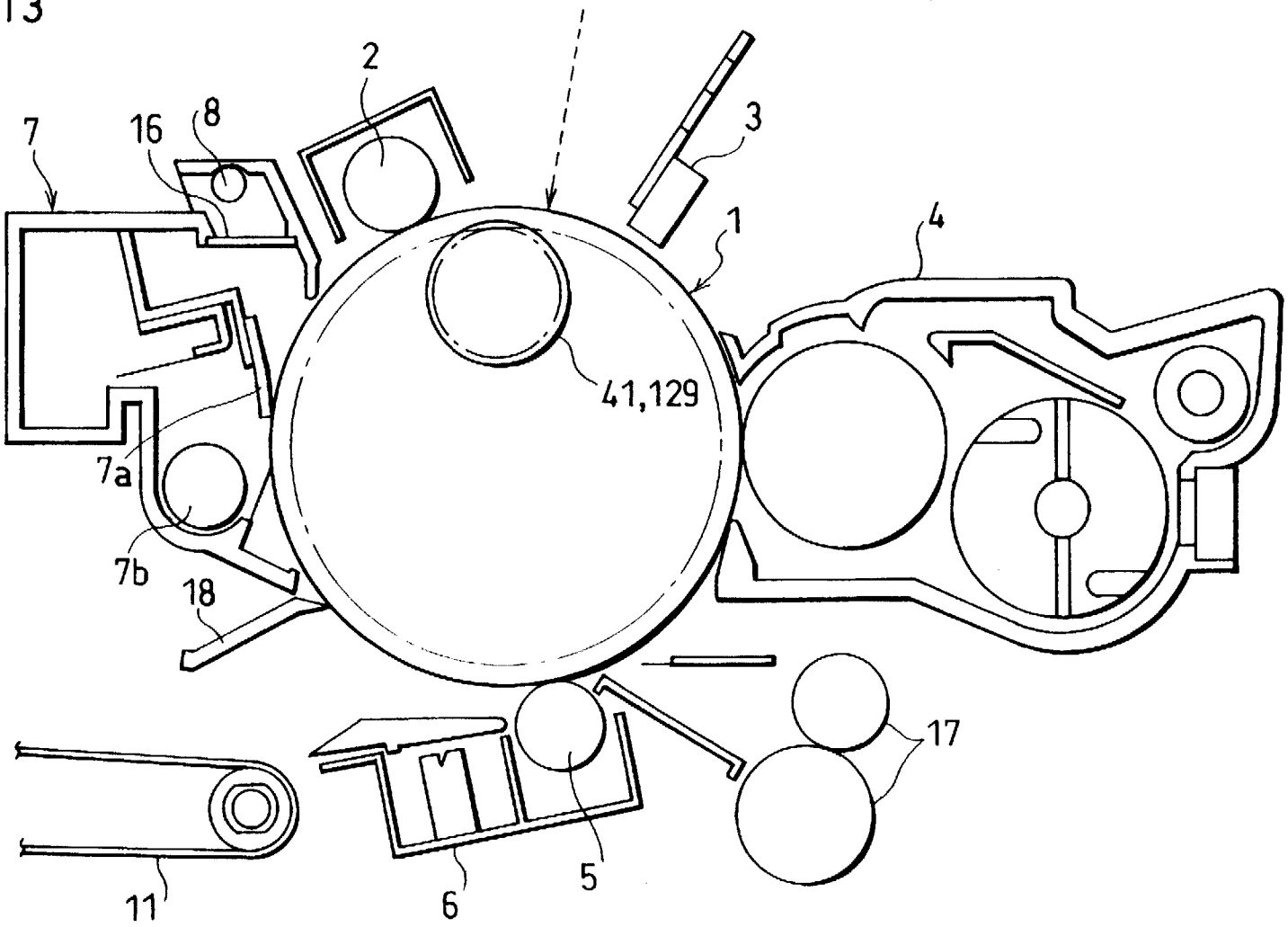
FIG. 13 is a cross-sectional view schematically showing an arrangement of the image forming apparatus in the copying machine of FIG. 12.

The structure of the circumferential portion of the photoreceptor drum 1 will be explained in further detail in reference to FIG. 13. The cleaning unit 7 wipes off the residual toner remaining on the surface of the photoreceptor drum 1 after the transfer by a cleaning blade 7*a* which is made in tight contact with the surface of the photoreceptor drum 1, and the toner thus wiped off is transported to a prescribed waste toner container by a transportation screw 7*b*. The remover lamp 8 is provided for projecting light onto the photoreceptor drum 1 via an anti-toner adhesion filter 16 onto the remover lamp 8. The main charger 2, the transfer charger 5 and the separation charger 6 are corona chargers which do not come in contact with the photoreceptor drum 1. On the sheet feeding side between the photoreceptor drum 1 and the transfer charger 5, provided is a paper stop roller 17 for adjusting a transportation timing of the sheet.

Here, a pre-transfer charger may be adopted under the developer roller 4*a* which aids the operation of the transfer charger 5.

A concrete example of the driving mechanism of the photoreceptor drum 1 to be adopted in the copying machine will be explained below.

FIRST EMBODIMENT

The following descriptions will discuss a photoreceptor drum driving mechanism for driving the described photoreceptor drum 1 in accordance with one embodiment of the present invention in reference to FIG. 1 through FIG. 6.

Figure 1:
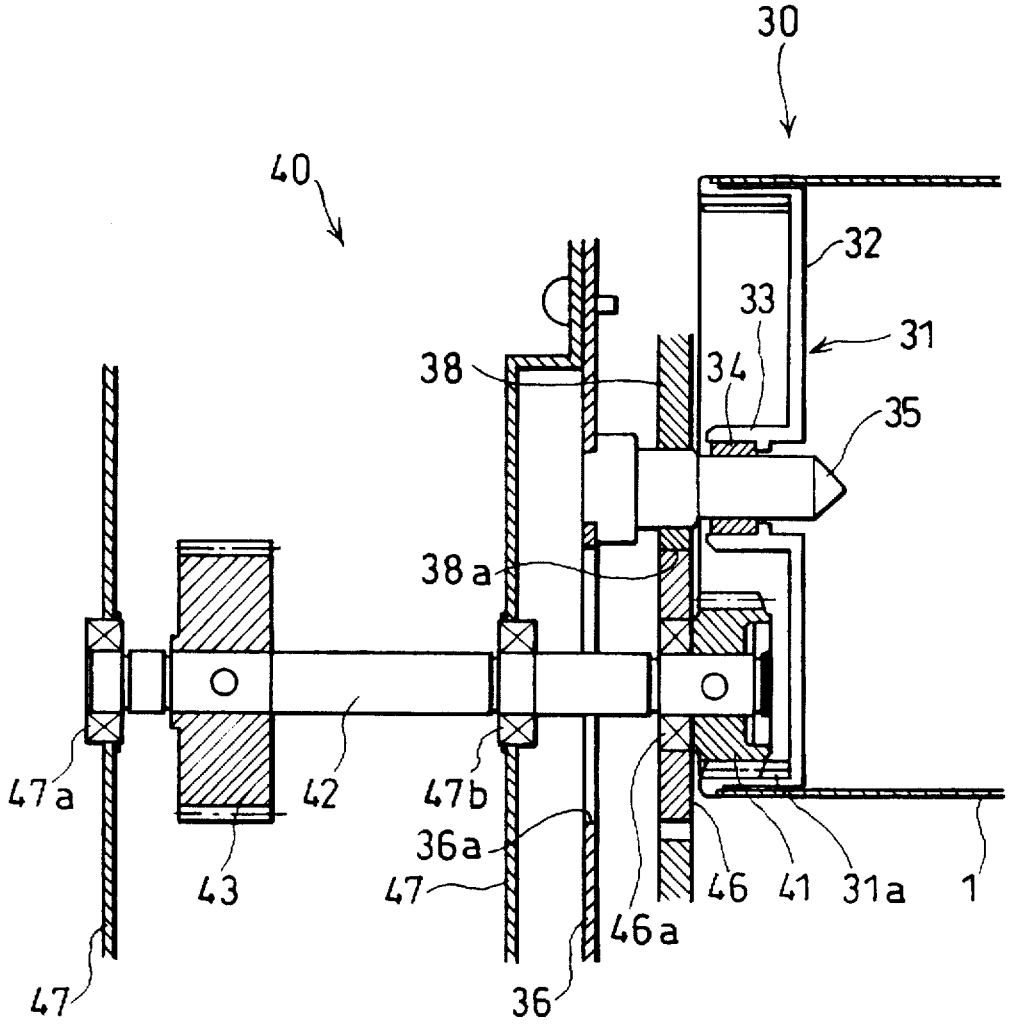
FIG. 1 is a cross-sectional view showing an example of a photoreceptor drum driving mechanism in accordance with the present invention.

As shown in FIG. 1, the photoreceptor drum driving mechanism is constituted by installing a photoreceptor unit 30 and a driving system unit 40 in a main flame 36. In the photoreceptor unit 30, the photoreceptor drum 1, etc., are incorporated. In the driving system unit 40, a drum drive gear 41, a drive shaft 42, etc., are incorporated. The described structure permits an easy decomposition and assembling, and an excellent maintenance efficiency.

Figure 3:
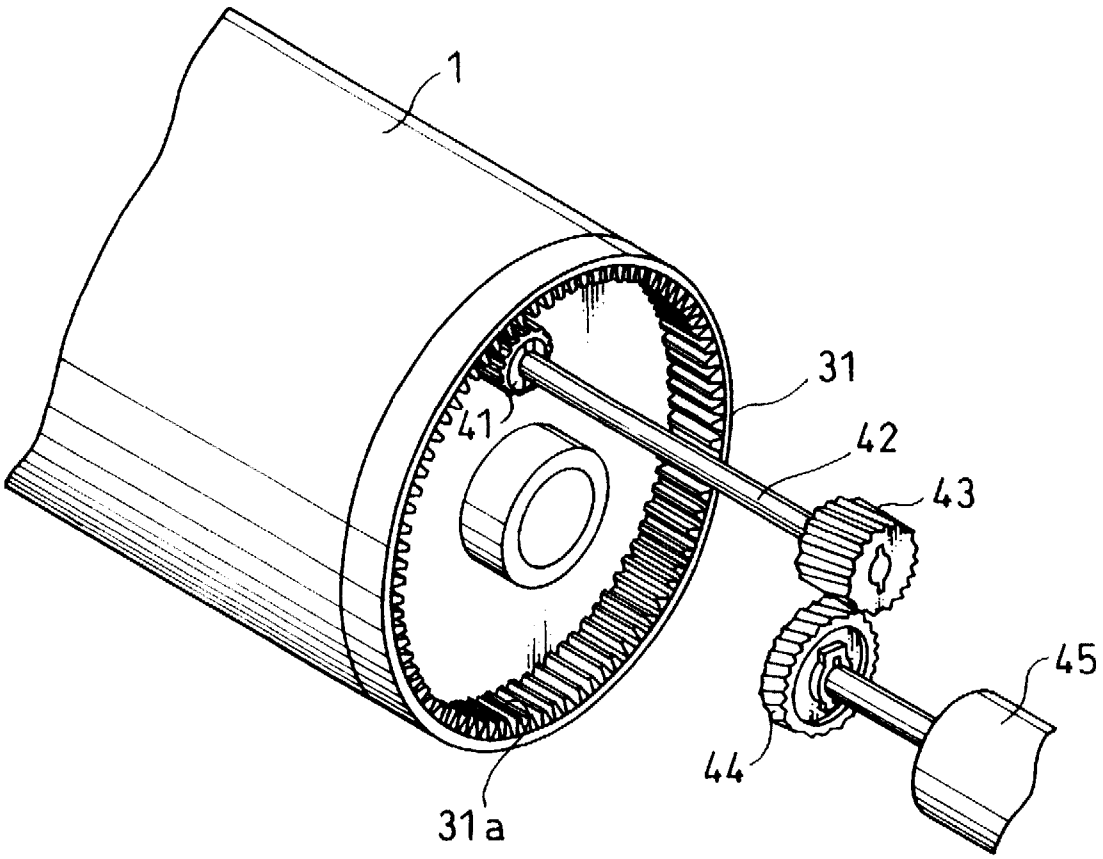
FIG. 3 is a perspective view showing a driving force transmission system of the photoreceptor drum driving mechanism.

As shown in FIG. 3, at the driven end side of the photoreceptor drum 1, press-fitted is a drum flange 31 (hereinafter simply referred to as a flange) with the internal gear 31*a* (internal drum gear) formed along the inner circumference thereof. The drive force produced by a drive motor 45 is transmitted to the internal gear 31*a* via the drum drive gear 41 in mesh with the internal gear 31*a*, an intermediate gear 43 mounted to the other end of the drive shaft 42 of the drum drive gear 41 and a pinion 44 in mesh with the intermediate gear 43, thereby driving the photoreceptor drum 1.

Further explanations are given referring back to FIG. 1. In the described arrangement, the flange 31 includes the internal gear 31*a*, an internal gear support member 32 which serves as a disk face perpendicularly formed with respect to the shaft of the photoreceptor drum 1 so as to support the internal gear 31*a*, and a rotation bearing member 33 formed at the center of the internal gear support member 32.

To the rotation bearing member 33, fitted is a rotation shaft 35 that is fixed to the main flame 36 of the copying machine main body via a bearing 34. The photoreceptor drum 1 rotates about the rotation shaft 35.

On the other hand, to the drive shaft 42 supported by bearings 47*a* and 47*b* with respect to the driving system unit 40, mounted are a roller 46 via a bearing 46*a* so as to be adjacent to the drum drive gear 41. The roller 46 is provided for preventing the drive shaft 42 from deflecting in the backlash increasing direction when the internal gear 31*a* is driven by the drum drive gear 41. The peripheral surface of the roller 46 is in contact with a circular arc surface (rolling surface) 38*a* formed on a photoreceptor unit flame 38 around the rotation shaft 35.

Figure 2:
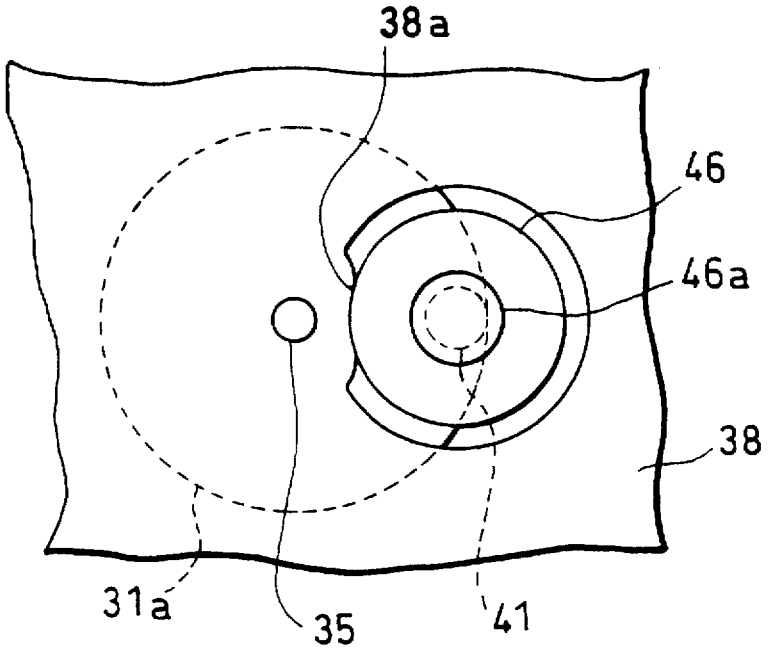
FIG. 2 is a side view schematically showing an arrangement in a vicinity of a roller of the photoreceptor drum driving mechanism.

As shown in FIG. 2, the circular arc surface 38*a* is formed along a part of the circumferential surface (circular arc) of the roller 46 on the side of the rotation shaft 35 of the photoreceptor drum 1. Therefore, by making the roller 46 in contact with the circular arc surface 38*a*, the roller 46 can be positioned in reference to the position of the rotation shaft 35. Here, as the photoreceptor drum 1 is also positioned based on the rotation shaft 35, respective positions of the internal gear 31*a* and the drum drive gear 41 are ultimately determined.

By placing the roller 46, the drive shaft 42 (see FIG. 1) is supported at a position closer to the drive gear 41, a backlash between the drum drive gear 41 and the internal gear 31*a* in the active state is not likely to deviate from the predetermined value. Namely, the problem of looseness is less likely to occur, and the internal gear 31*a* can be driven smoothly by the drum drive gear 41 without generating irregularities in rotation movement. Moreover, in the main flame 36, an opening 36*a* is formed with a size which allows the roller 46 to pass therethrough, and with the drum drive gear 41 attached to the driving system unit 40, the installation and removal of the driving system unit 40 can be performed.

Figure 4:
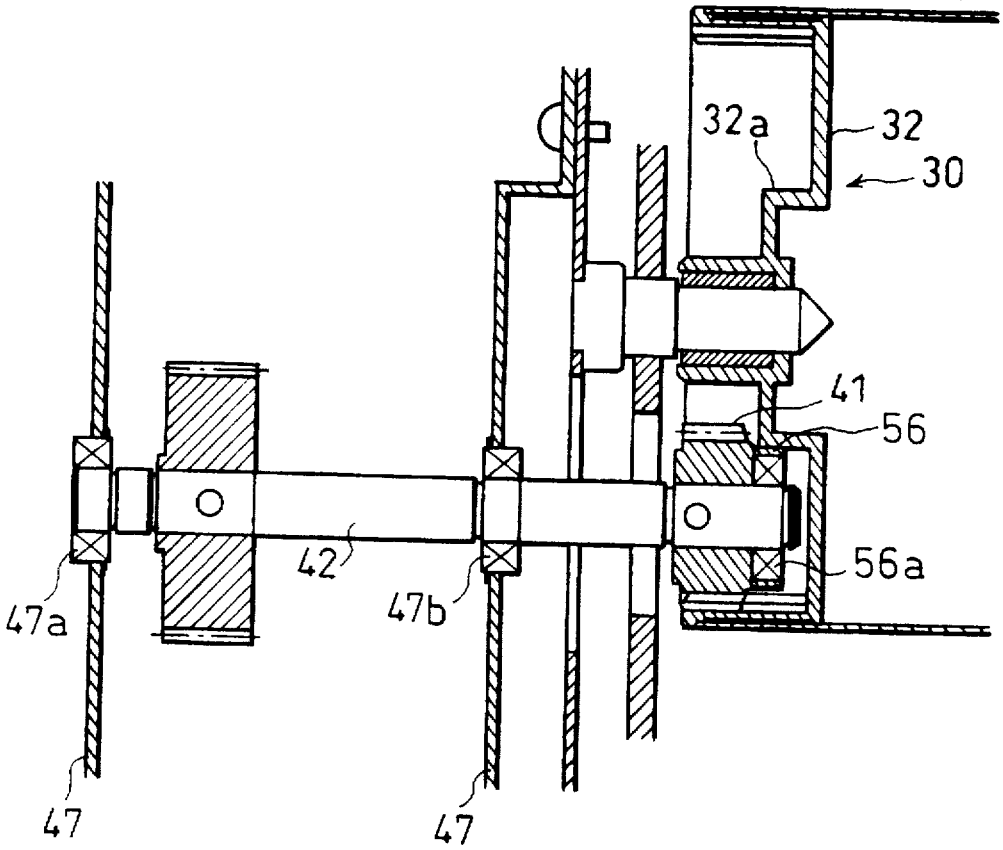
FIG. 4 is a cross-sectional view showing another example of the photoreceptor drum driving mechanism in accordance with the present invention.

Other than the described arrangement of the photoreceptor drum driving mechanism shown in FIG. 1, the arrangement shown in FIG. 4 may be adopted. That is, the roller 56 is mounted to the leading end of the drive shaft 42 with respect to the drum drive gear 41. In this case, it is necessary to provide the rolling surface 32*a* in contact with the roller 56 in the internal gear support member 32. Here, the deflection of the drive shaft 42 can be reduced as being held by the roller 56 and the rolling face 32*a*, at the side where a large amount of deflection is generated, thereby improving a positioning precision of the drum drive gear 41.

However, like the arrangements shown in FIG. 1 and FIG. 4, when more than three bearings are formed with respect to the drive shaft 42, the force exerted in the bending direction to be loaded to the drive shaft 42 is in the statically indeterminate state, which hinders the smooth rotation of the drive shaft 42. Therefore, it is required to set the mating clearance between the bearing 47*b* and a drive frame 47 to fall in a range of from 0.1 to 0.2 mm, that is larger than a normal range of from 0.01 to 0.05 mm. As a result, the stress imposed on the drive shaft 42 and the bearings 47*a*, 47*b*, 46*a* and 56*a* can be reduced, and the rotation movement of the drive shaft 42 is not disturbed.

Figure 5A:
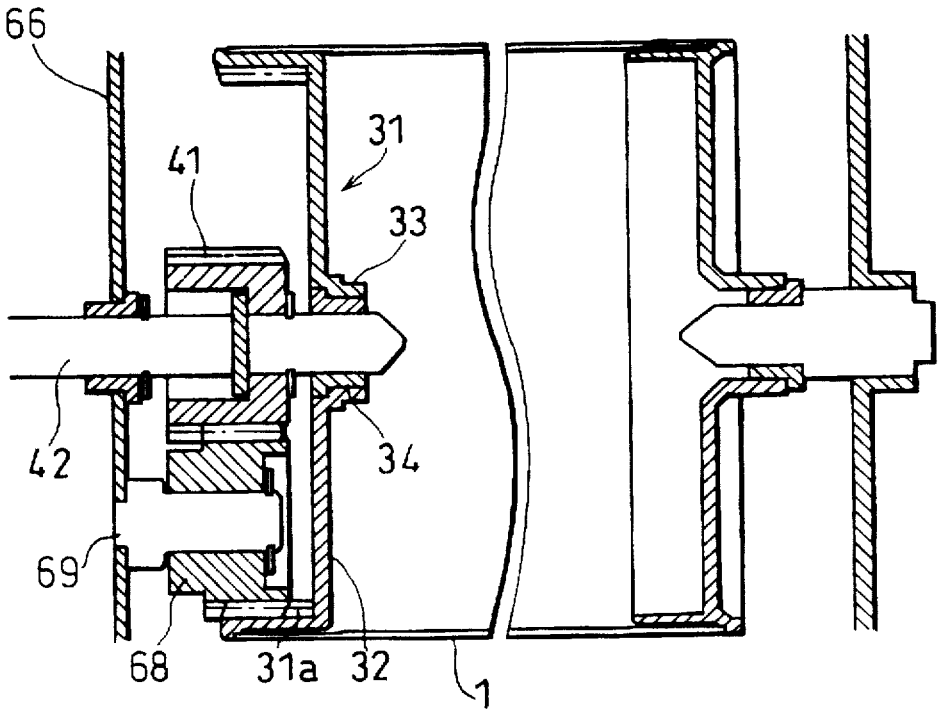
FIG. 5(*a*) is a cross-sectional view of another example of the photoreceptor drum driving mechanism in accordance with the present invention.
Figure 5B:
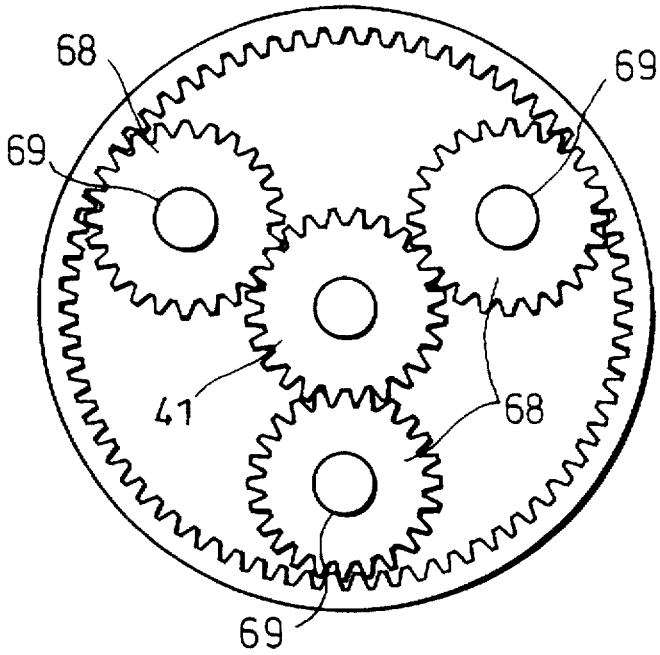

Furthermore, the photoreceptor drum driving mechanism may be arranged as shown in FIG. 5(*a*). At the driven end of the photoreceptor drum 1, the flange 31 with the internal gear 31*a* is press-fitted. The flange 31 includes the internal gear 31*a*, the internal gear support member 32 which serves as a disk surface formed on the face perpendicular to the shaft of the photoreceptor drum 1 so as to support the internal gear 31*a* and the rotation bearing member 33 formed at the center of the internal gear support member 32. To the rotation bearing member 33, fitted is the leading end portion of the drive shaft 42 via the bearing 34. The drive shaft 42 serves both as the rotation shaft of the drum drive gear 41 and as the rotation shaft of the photoreceptor drum 1.

Intermediate gears 68 (see FIG. 5(*b*)) are provided respectively on the three rotation shafts 69 which are fixed in such a manner that respective central angles are equal to each other around the rotation shaft (drive shaft 42) of the photoreceptor drum 1. In this arrangement, when driving the drive motor (not shown), the three intermediate gears 68 are in mesh with the internal gear 31*a*, and the drive force of the drum drive gear 41 mounted to the same shaft as the rotation center of the photoreceptor drum 1 is transmitted to the internal gear 31*a*, and this, in turn, actuates the rotation movement of the photoreceptor drum 1 about the drive shaft 42.

In the described arrangement, the number of the intermediate gears 68 is selected to be three as the most stable balance of the forces produced by the intermediate gears 68 can be achieved although it is possible to disperse the force in the direction of pressure angle with at least two intermediate gears 68.

In the described arrangement, as the three intermediate gears 68 for driving the internal gear 31*a* are provided at equal intervals with respect to the drum drive gear 41, the force in the pressure angle direction generated between the internal gear 31*a* and the intermediate gear 68 would be reduced to one third. Further, as forces in respective directions are balanced each other, the possible deflection of the rotation shaft 69 of the intermediate gear 68 which causes the irregularities of rotations can be eliminated. Moreover, the photoreceptor drum 1 itself is held by the rotation bearing member 33 provided at the center of the flange 31, thereby preventing the deviation of the center of the rotation shaft.

Figure 6A:
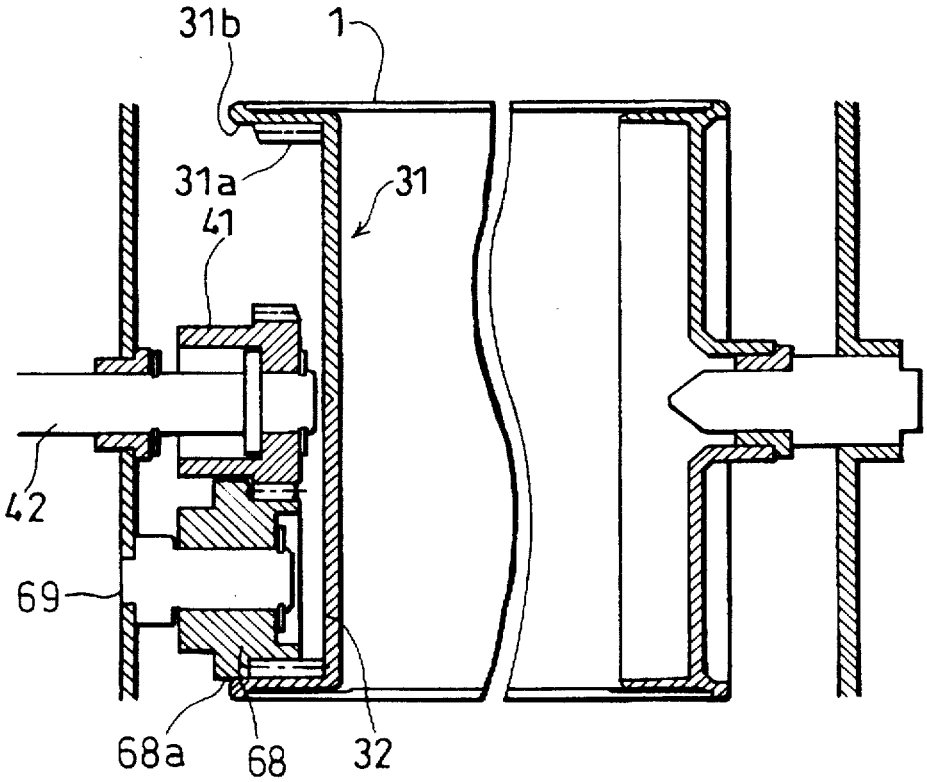
FIG. 6(*a*) is a cross-sectional view of still another example of the photoreceptor drum driving mechanism in accordance with the present invention.
Figure 6B:
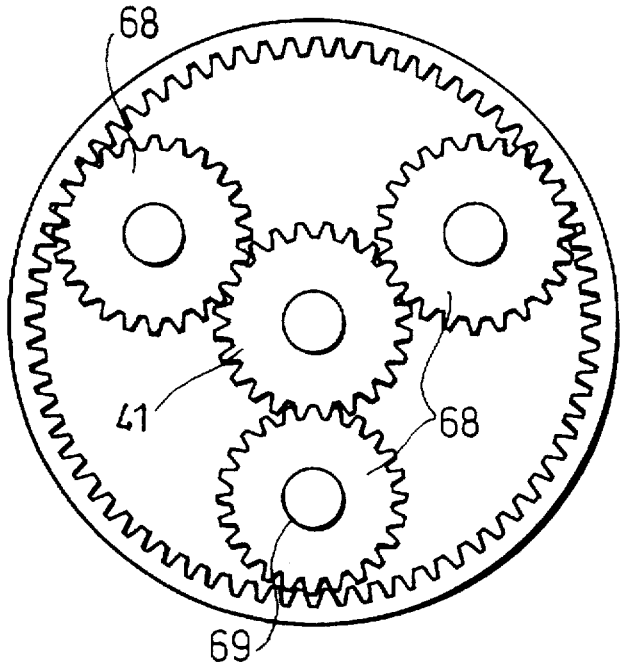
Figure 7:
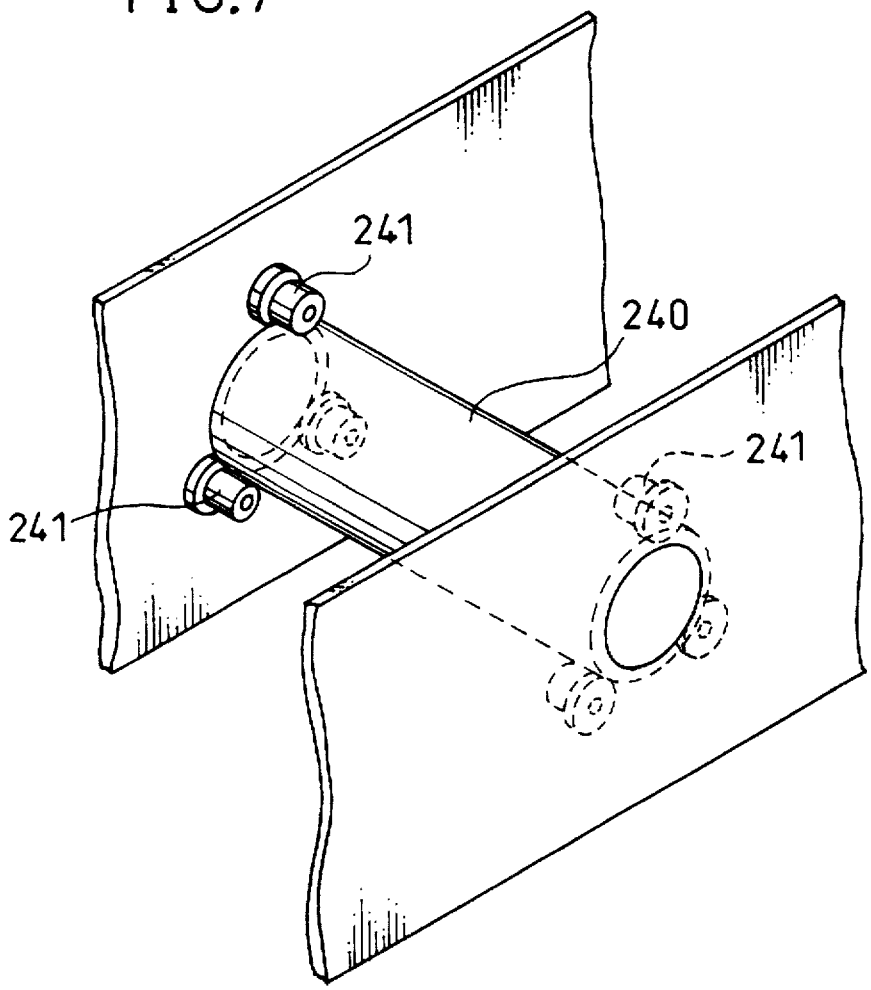
FIG. 7 is a perspective view showing a structure of supporting the photoreceptor drum in the conventional photoreceptor drum driving mechanism.
Figure 8:
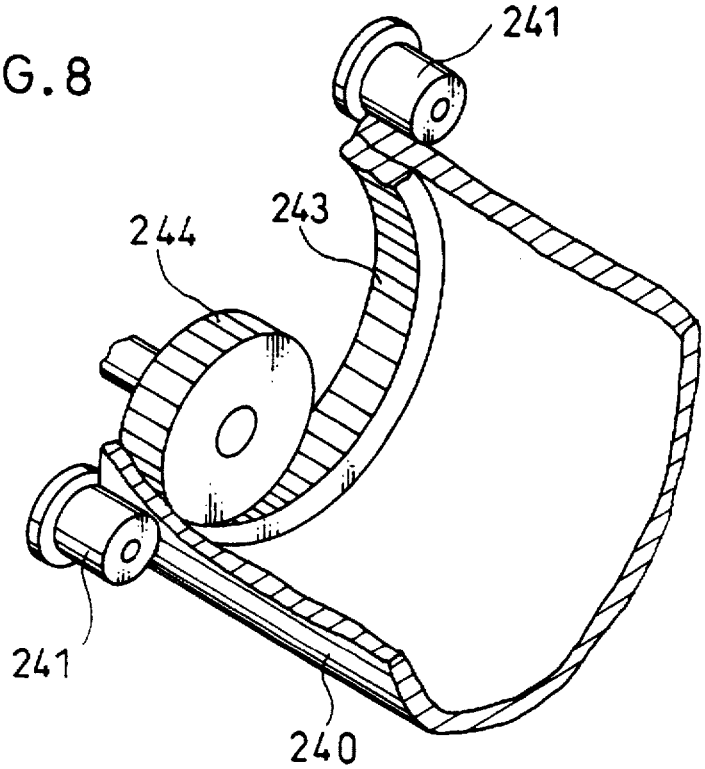
FIG. 8 is a partial cutaway perspective view of a driving system of the conventional photoreceptor drum driving mechanism of FIG. 7.
Figure 9:
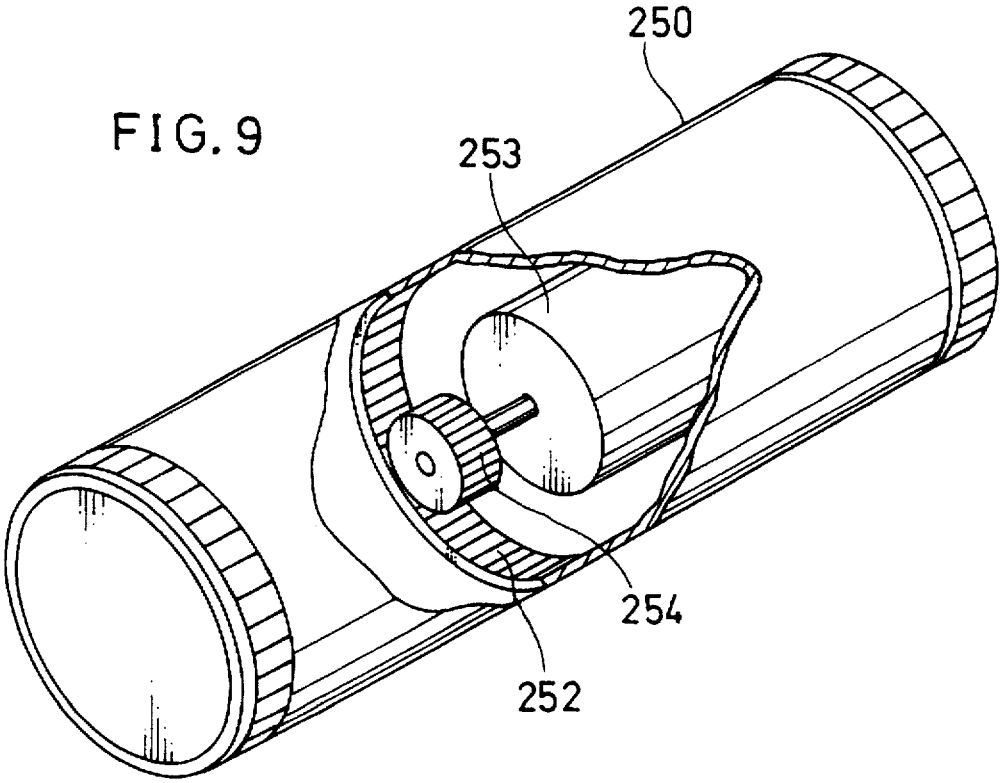
FIG. 9 is a partial cutaway perspective view of another driving system of the conventional photoreceptor drum driving mechanism.
Figure 10:
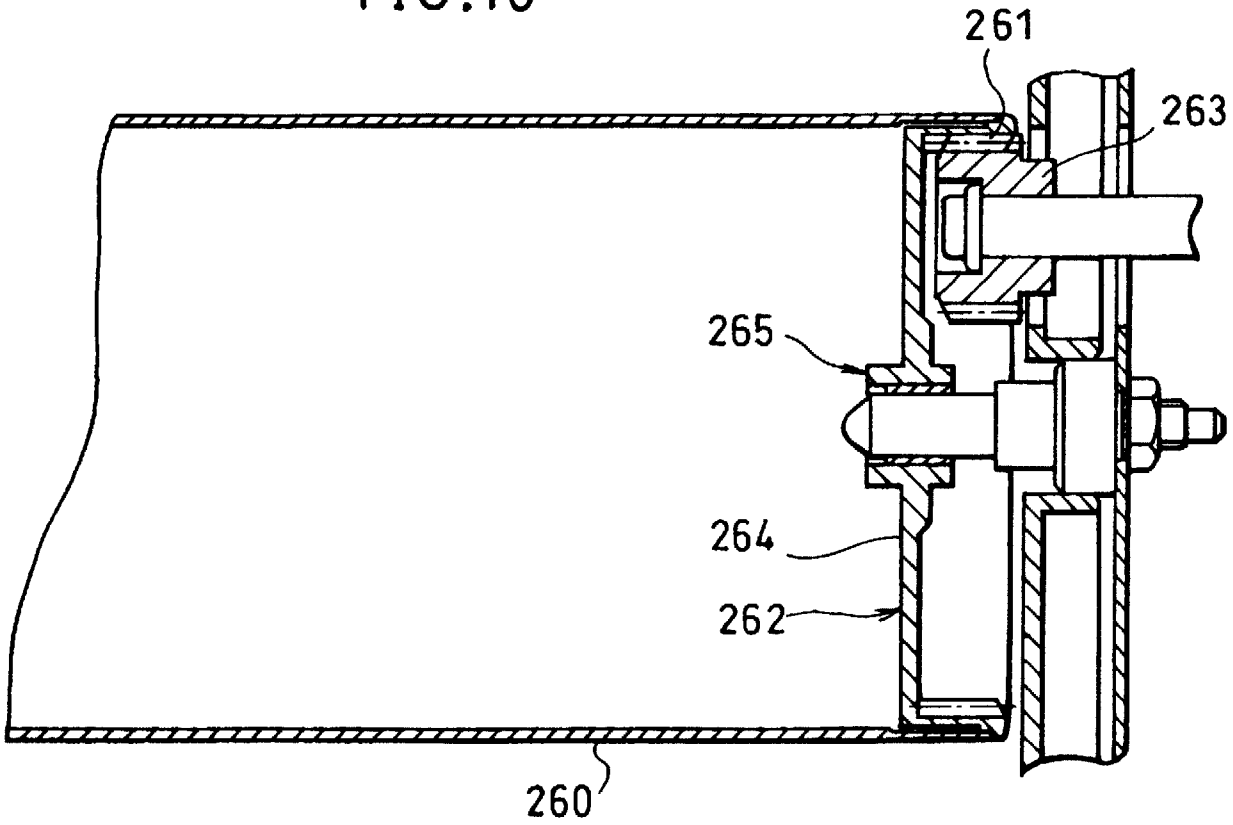
FIG. 10 which shows still another driving system in the conventional photoreceptor drum driving mechanism is across-sectional view of essential parts of the driving system.
Figure 11A:
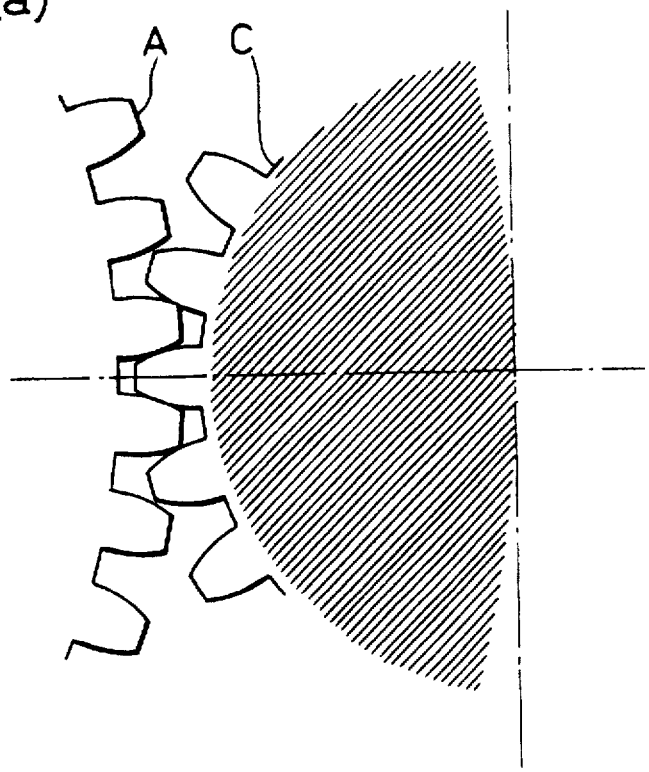
FIG. 11(*a*) which shows a region of increasing a backlash when gears on the driving side and on the driven side are in mesh with each other is an explanatory view showing an engagement in the case where the driven side is also the external gear.
Figure 11B:
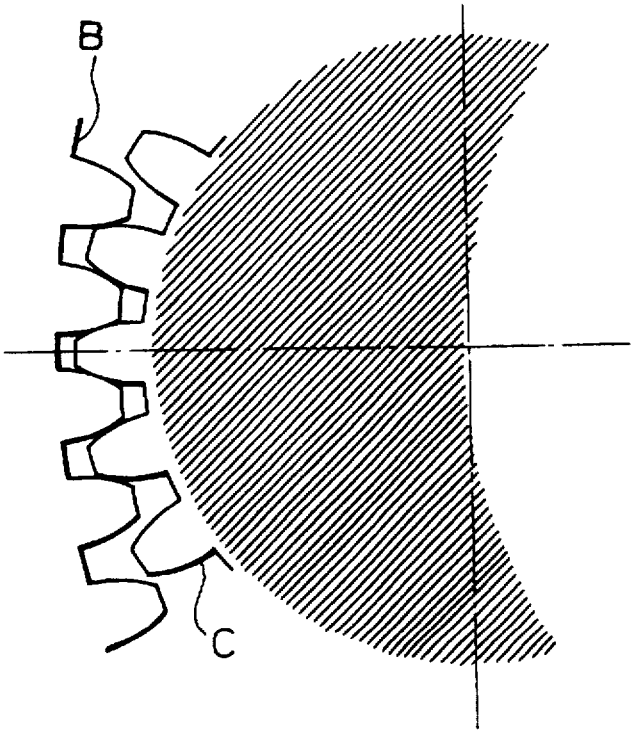

The photoreceptor drum driving mechanism may be arranged as shown in FIGS. 6(*a*) and (*b*). Rollers 68*a* are coaxially formed with the intermediate gears 68 respectively, and a rolling surface 31*b* is formed with respect to the rollers 68*a* on the side of the flange 31. In this case, the axial position of the photoreceptor drum 1 is stabilized by the rollers 68*a* and the rolling surface 31*b*, and the deviation in the rotation center can be prevented without the rotation shaft for the flange 31 as in the aforementioned case.

Conventionally, in order to ensure the precision, a ball bearing which is inferior in its durability is adopted as the bearing. In contrast, the preferred embodiment of the present invention is provided with the structure of improving a positioning precision for the drum drive gear 41, and this permits the radial roller bearing represented by a needle bearing, etc., which shows fairly high durability to be adopted. By adopting such radial roller bearing, an improved precision can be ensured for a long period of time.

As described, by preventing the looseness and irregularities in rotations of the photoreceptor drum 1, a possible distorted image can be reduced.

SECOND EMBODIMENT

The following descriptions will discuss a photoreceptor drum driving mechanism for driving the photoreceptor drum 1 in accordance with another embodiment of the present invention in reference to FIG. 14 through FIG. 21. The photoreceptor drum driving mechanism in accordance with the present embodiment is arranged such that a drum drive gear and a brake gear are in mesh with a drum gear mounted to the photoreceptor drum 1, and the photoreceptor drum 1 is driven with an application of a brake force, thereby preventing the looseness due to a backlash, etc., thereby preventing irregularities or deviation in rotations, etc.

Figure 14:
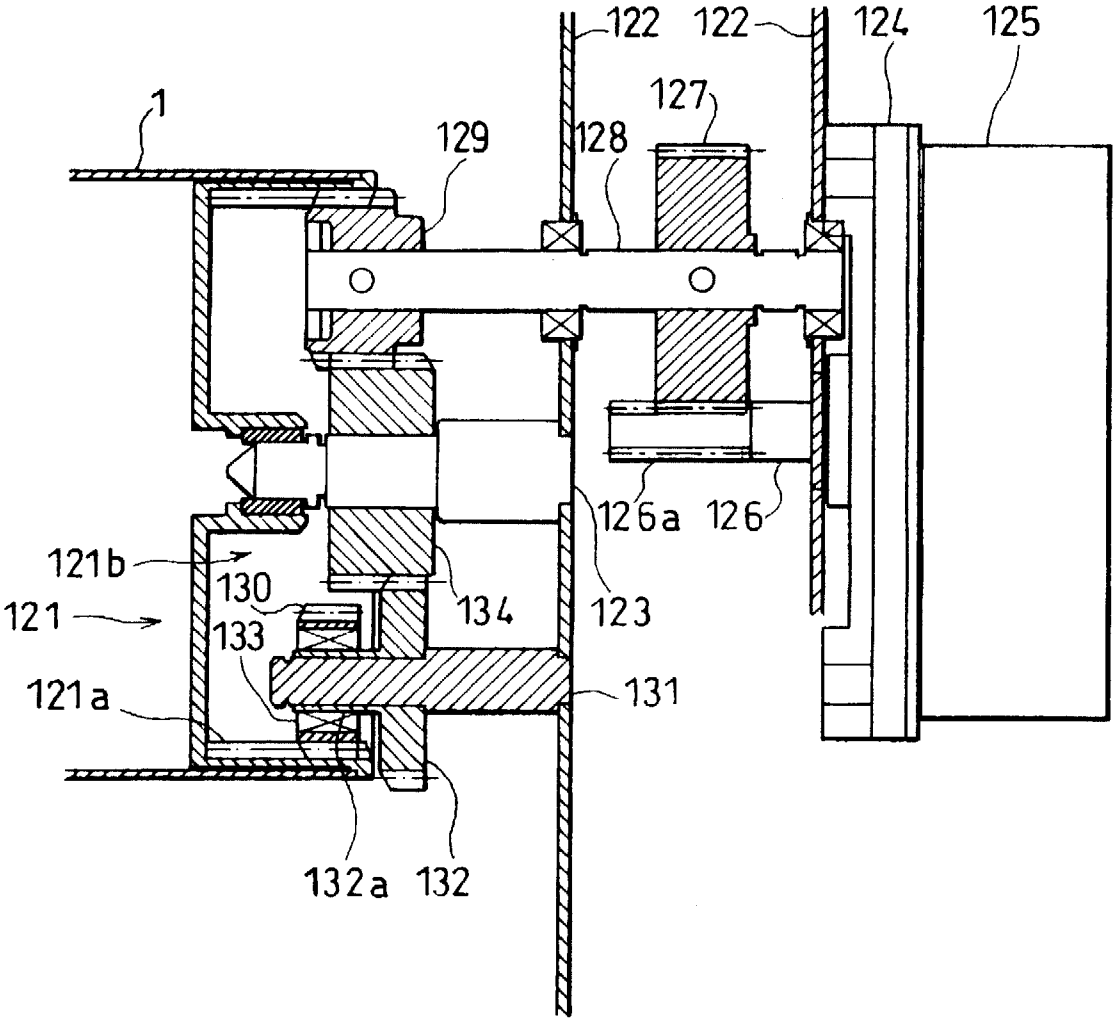
FIG. 14 is a cross-sectional view showing another photoreceptor drum driving mechanism in accordance with the present invention.
Figure 15:
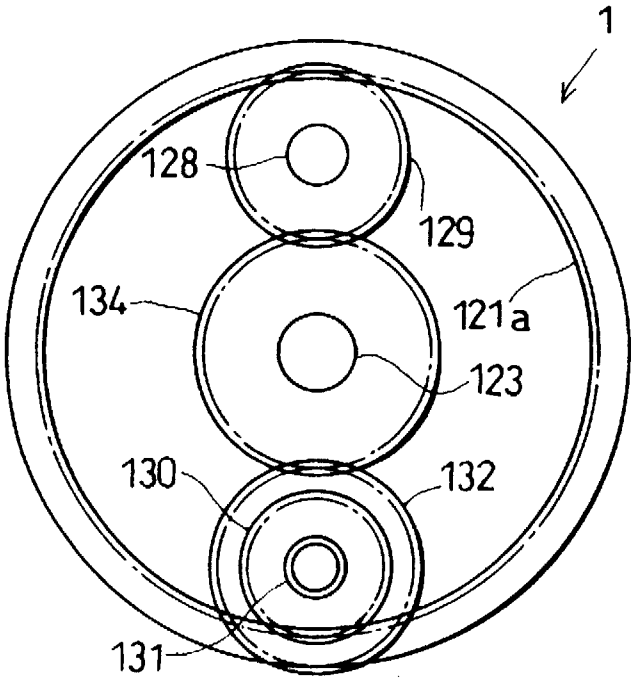
FIG. 15 is an arrangement drawing showing a relative position of the gears in the photoreceptor drum driving mechanism of FIG. 14.

As shown in FIG. 14, a drum gear 121*a* (a drum gear unit, an internal drum gear) and a flange 121 with a rotation bearing member 121*b* are press-fitted to one end of the photoreceptor drum 1, and the rotation bearing member 121*b* is rotatably supported by a drum support shaft 123 (corresponding to the rotation shaft in the first embodiment) that is caulked to a flame 122. On the other hand, although the drum gear is not formed, the flange is rotatably provided in the described manner also at the other end (not shown) of the photoreceptor drum 1. The described arrangement permits the rotating movement of the photoreceptor drum 1.

A drive motor 125 for driving the photoreceptor drum 1 is fixed to a drive flame 124, and at the leading end of a motor shaft 126 projected from the drive motor 125, a pinion 126*a* is formed. The drive force produced by the drive motor 125 is transmitted to a drive shaft 128 through an intermediate gear 127 in mesh with the pinion 126*a*, and is further transmitted by the gears between a drum drive gear 129 mounted to the leading end in the direction of the photoreceptor drum 1 of the drive shaft 128 and the drum gear 121*a*, thereby rotating the photoreceptor drum 1.

On the other hand, a brake gear 130 is also in mesh with the drum gear 121*a*. The brake gear 130 is mounted inside the drum gear 121*a*, and the axis of the drive shaft 128, the axis of the drum support shaft 123 and the axis of the rotation shaft 131 which is the center of rotation of the brake gear 130 are on one plane (see FIG. 15).

The brake gear 130 is supported via a torque limiter 133 on a hollow shaft section 132*a* extending from the intermediate gear 132 mounted on the rotation shaft 131 so as to be rotatable. Further, the rotation force of the drive shaft 128 is transmitted to the brake gear 130 by an intermediate gear 134 that is rotatably supported by the drum support shaft 123 so as to be in mesh with the drum drive gear 129.

Here, if there exits a relative difference between the speed of rotation of the drum gear 121*a* produced by driving the drum drive gear 129 and the speed of rotation of the drum gear 121*a* produced by driving the brake gear 130, the torque limiter 133 is actuated, and the brake force is applied to the drum gear 121*a*. With the described combination of gears., the brake gear 130 is rotated in the rotating direction of the drum gear 121*a*. Here, the speed reducing ratio is set such that the speed of rotation of the drum gear 121*a* produced by the brake gear 130 does not exceed the speed of the rotation of the drum gear 121*a* produced by the drum drive gear 129.

Therefore, as the number of rotations to be transmitted to the brake gear 130 via the drum gear 121*a* from the drum drive gear 129 becomes larger than the number of rotations to be transmitted from the drum drive gear 129 to the intermediate gear 134, the intermediate gear 132 and the brake gear 130, the brake force is exerted from the brake gear 130 to the photoreceptor drum 1.

For example, assumed the respective number of teeth of the drum gear 121*a*, the drum drive gear 129, the brake gear 130, the intermediate gear 132, the pinion 126*a*, and the intermediate gear 134 are 72, 22, 18, 26, 7, and 40, and the number of rotations of the drive motor 125 is 1,500 rpm, then the number of rotations of the photoreceptor drum 1 would is 80.2 rpm, while the number of rotations to be applied to the photoreceptor drum 1 by the brake gear 130 would be 55.5 rpm. Therefore, under the described condition, the difference between a number of rotations internally applied to the torque limiter 133 and a number of rotations externally applied to the torque limiter 133 would be 24.7 rpm, and this difference would cause the brake force to be generated with respect to the photoreceptor drum 1.

As described, when the number of rotations to be applied to the torque limiter 133 is small, for example, a spring clutch type torque limiter represented by a torque limiter unit NTS series (NTN Co., Ltd.) may be used.

By the described brake force, the teeth of the drum gear 121*a* would always receive a force exerted in an opposite direction to the rotating direction of the drum drive gear 129 with respect to the teeth of the drum drive gear 129. As a result, looseness in backlash is eliminated, thereby preventing fluctuation between gears.

In the described preferred embodiment, the drum drive gear 129 and the brake gear 130 are formed inside the photoreceptor drum 1, and this permits the arrangement of preventing the fluctuation between the gears to be added to the image forming apparatus without adversely affecting other arrangements disposed outside of the photoreceptor drum 1, such as the layout of the members including the charger, the developer unit, the cleaning unit, etc.

Figure 16:
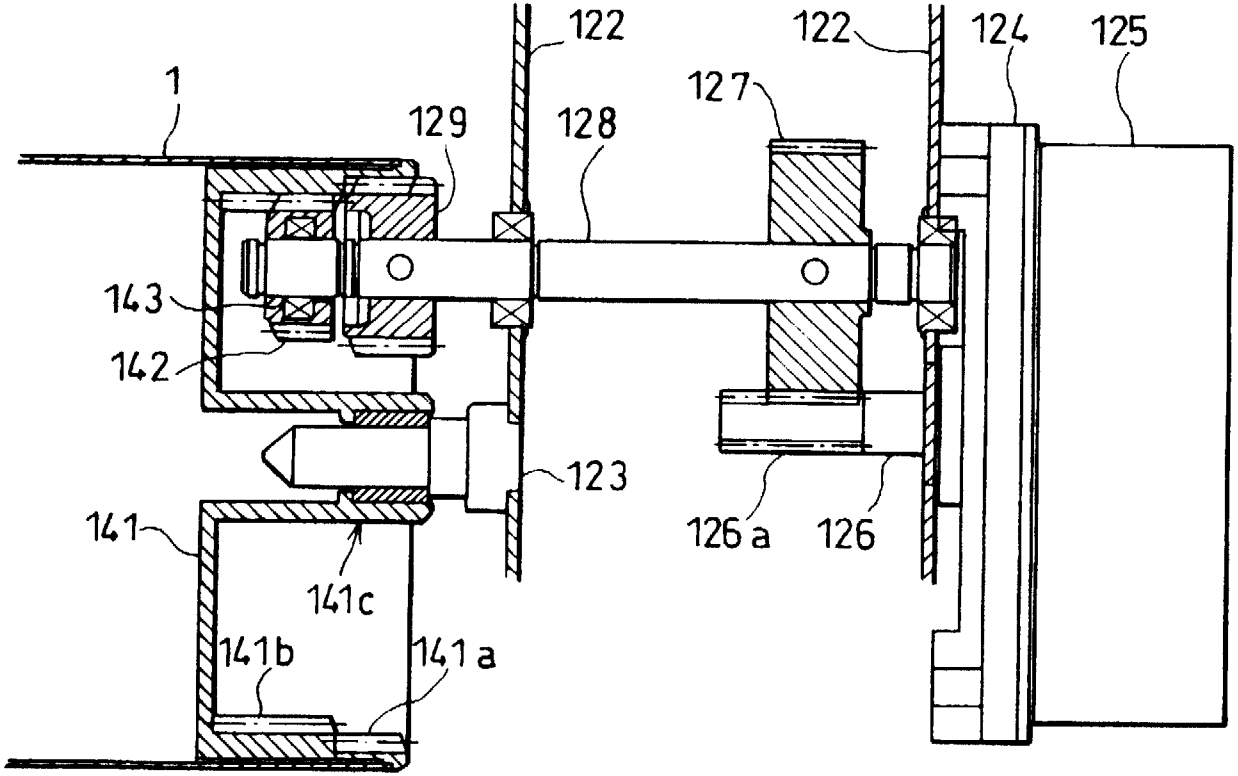
FIG. 16 is a cross-sectional view showing still another photoreceptor drum driving mechanism in accordance with the present invention.

The photoreceptor drum driving mechanism may be arranged as shown in FIG. 16. That is, a drum gear 141*a*, a brake gear 141*b* and a flange 141 with a rotation bearing member 141*c* are press-fitted to one end of the photoreceptor drum 1. The rotation bearing member 141*c* is rotatably supported by the drum support shaft 123 and a drum support shaft (not shown) of the other end.

By the gear transmission mechanism via the pinion 126*a* which is formed at the leading end of the motor shaft 126 of the drive motor 125 fixed to the drive flame 124, the intermediate gear 127, the drive shaft 128 and the drum drive gear 129, the drive force produced from the drive motor 125 is transmitted to the photoreceptor drum 1.

On the other hand, a brake gear 142 is mounted to the drive shaft 128 at position closer to the leading end than the drum drive gear 129 through a torque limiter 143, so as to be in mesh with the brake drum gear 141*b*.

In this embodiment, the module $m_1$ and the number of teeth $Z_1$ of the drum drive gear 129, and the module $m_2$ and the number of teeth $Z_2$ of the brake gear 142 satisfy the condition of $m_1 \times z_1 > m_2 \times Z_2$. Namely, the pitch circle of the drum drive gear 129 is greater than the pitch circle of the brake gear 142. Therefore, a greater difference would arise between the number of rotations transmitted to the brake gear 142 by the drive shaft 128 and the number of rotations transmitted to the brake gear 142 by the drive shaft 128 through the drum drive gear 129, the drum gear 141*a* and the brake drum gear 141*b*. The described difference causes the brake force to be exerted to the photoreceptor drum 1 by the brake gear 142.

For example, assumed the respective numbers of teeth of the drum gear 141*a*, the brake drum gear 141*b*, the drum drive gear 129, the brake gear 142, the pinion 126*a*, and the intermediate gear 127 are 72, 68, 22, 18, 7 and 40, and the number of rotations of the drive motor 125 is 1,500 rpm, and the transmission efficiency between respective gears is 100 percent, then the number of rotations of the photoreceptor drum 1 would be 80.2 rpm with an drag regulation value of the torque limiter 143 of 1 kgf cm, while the number of rotations to be applied to the photoreceptor drum 1 by the brake gear 142 would be 69.5 rpm. Therefore, the difference between a number of rotations would be 10.7 rpm. In this case, the shaft drag load (brake force) to be applied to the photoreceptor drum 1 would be 3.7 kgf cm.

As described, when the number of rotations to be applied to the torque limiter 143 is small, for example, the spring clutch type torque limiter represented by a torque limiter unit NTS series (NTN Co., Ltd.) may be used.

By the described brake force, the teeth of the drum gear 141*a* would always receive a force exerted in an opposite direction to the rotating direction of the drum drive gear 129 with respect to the teeth of the drum drive gear 129. As a result, the looseness due to a backlash is eliminated, and the fluctuation between gears is prevented.

Figure 17B:
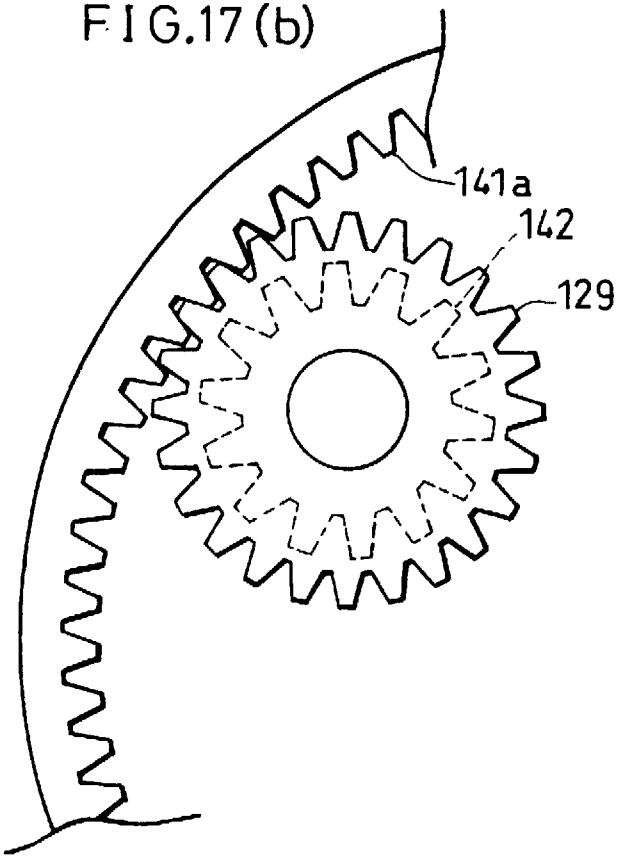
FIG. 17(*a*) is an explanatory view of the case where the relative position between the drum drive gear and the brake gear when seen from the drive unit side satisfies the condition of $m_1(z_1-2.5)<m_2(z_2+2)$ in FIG. 16.
Figure 17A:
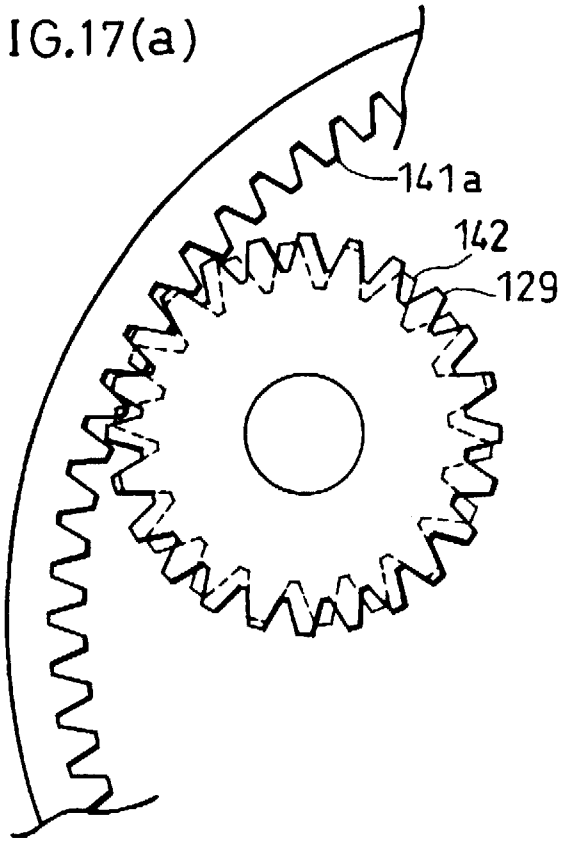
Figure 18:
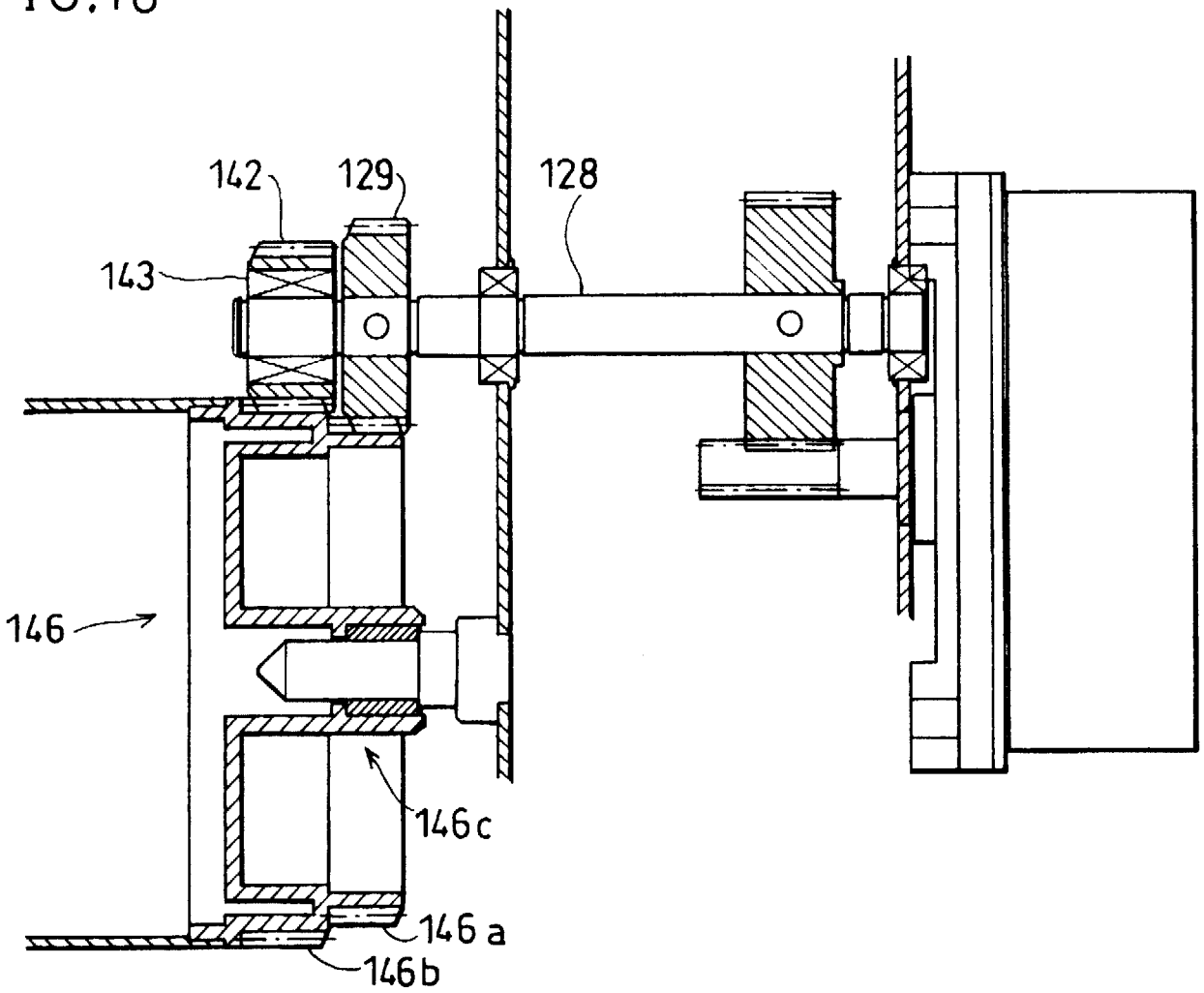
FIG. 18 is a cross-sectional view showing still another photoreceptor drum driving mechanism in accordance with the present invention.

In the described arrangements, in such situations where there is no significant difference in pitch circle diameters of the drum drive gear 129 and the brake gear 142, as shown in FIG. 17, the teeth of the brake gear 142 in the back may overlap the teeth of the drum gear 141*a* in some region (see FIG. 17(*a*)). In this photoreceptor drum driving mechanism, by sliding the drive shaft 128 in the horizontal direction, installation and removal of the drive unit including the drive motor 125, etc., are permitted. Therefore, in situations where the described correlation between the drum drive gear 129 and the brake gear 142 is satisfied, the teeth of the brake gear 142 and the teeth of the drum gear 141*a* interfere with each other, which unable the installation and removal of the drive unit.

In the preferred embodiment, the module $m_1$ and the number of teeth $Z_1$ of the drum drive gear 129, and the module $m_2$ and the number of teeth $Z_2$ of the brake gear 142 satisfy the condition of $m_1(z_1-2.5) \leqq m_2(Z_2+2)$. In this case, as shown in FIG. 17(*b*), as the diameter of the tip circle of the brake gear 142 is smaller than the diameter of the root circle of the drum drive gear 129, an interference between the teeth of the brake gear 142 and the teeth of the drum gear 141*a* can be avoided.

As in the aforementioned first embodiment, the photoreceptor drum driving mechanism shown in FIG. 16 is placed inside the photoreceptor drum 1 without affecting the layout of respective members of the image forming apparatus.

Although the explanations have been given through the case of the photoreceptor drum driving mechanism of the internal gear system, alternate embodiment may be arranged such that the drive shaft 128 is provided outside the photoreceptor drum 1, and a drum gear (external drum gear) 146*a* and a brake gear 146*b* function as the external gears. In this case, it is required to provide the drive shaft 128 outside the photoreceptor drum 1 for the photoreceptor drum driving mechanism. However, as only one rotation shaft is formed outside the photoreceptor drum 1 as in the conventional device, the effects on other arrangement in the image forming apparatus would be small, thereby eliminating the looseness due to a backlash, and preventing the fluctuation between gears without significantly altering the conventional positioning space and the layout.

Figure 19:
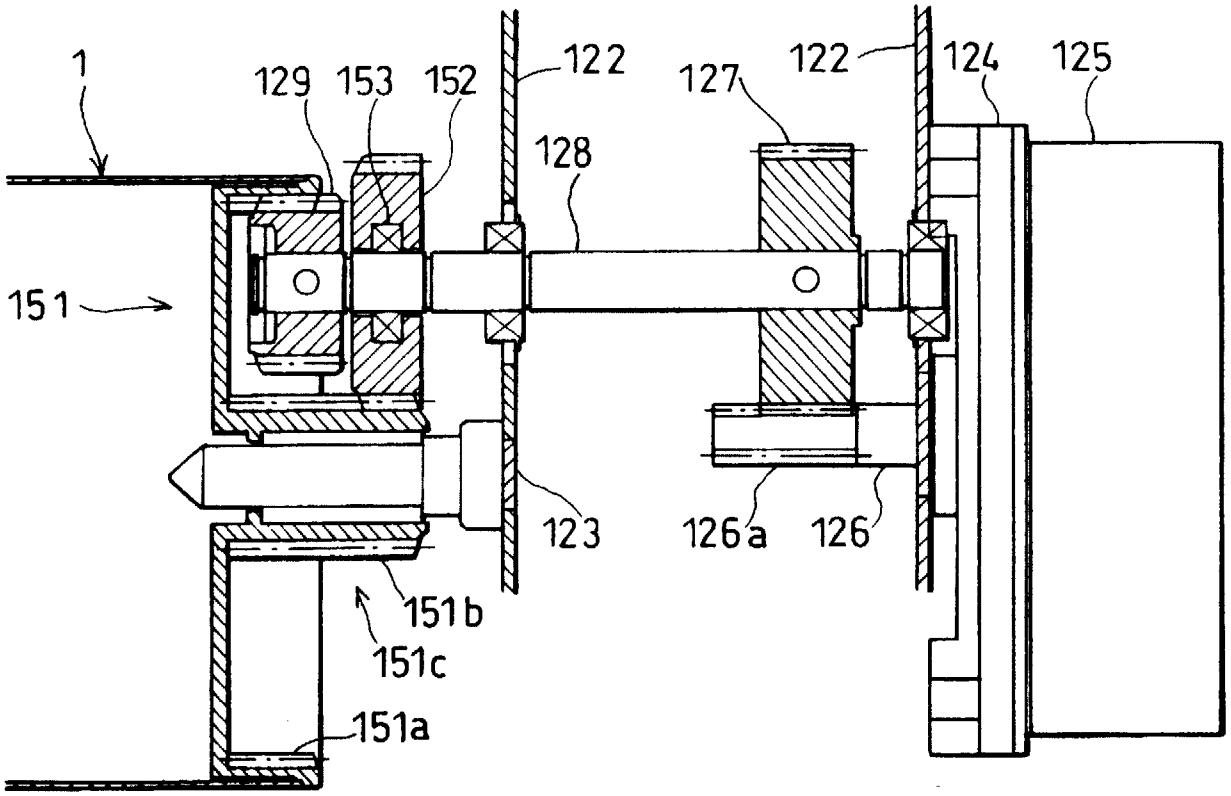
FIG. 19 is a cross-sectional view showing still another photoreceptor drum driving mechanism of the present invention.

The photoreceptor drum driving mechanism may be arranged as shown in FIG. 19. As shown in FIG. 19, a flange 151 which is press-fitted to one end of the photoreceptor drum 1 includes an internal drum gear 151*a* formed along the circumference thereof as in the case of the arrangement of FIG. 16 and an external brake drum gear 151*b* mounted to a rotation bearing member 151*c* of the flange 151.

The photoreceptor drum 1 is rotatably supported by a drum support shaft 123 which is caulked to the flame 122 and a drum support shaft (not shown) formed at the other end.

To the leading end of the drive shaft 128 which receives the drive force from the drive motor 125, the drum drive gear 129 in mesh with the drum gear 151*a* is mounted as well as a brake gear 152 in mesh with the brake drum gear 151*b* via a torque limiter 153.

In this case, the direction of rotations to be applied to the brake gear 152 by the brake drum gear 151*b* is opposite to the direction of rotations to be applied to the drum gear 151*a* by the drum drive gear 129.

As a result, in the torque limiter 153, slipping occurs between the drive shaft 128 and the brake gear 152, and the rotating force to be applied to the brake gear 152 by the brake drum gear 151*b* is exerted as the brake force, and a possible looseness due to a backlash can be avoided.

Here, as rotations to be applied to the brake gear 152 has an opposite direction to the rotating direction of the drive gear 128, the relative number of rotations of the brake gear 152 with respect to the drive shaft 128, i.e., the difference in number of rotations to be applied to the torque limiter 153 becomes larger.

In the described situations, for example, a powder clutch system torque limiter represented by the powder clutch OPL series (Ogura Clutch Co., Ltd.) which offers a stable load at high-speed rotation range (around 50 to 300 rpm) may be used.

In each of the described preferred embodiment, as the restrictions on the torque limiter to be adopted can be reduced by altering the setting of the gear ratio, an optimal selection of the torque limiter can be made with ease in consideration of the brake force, the durability and the cost, etc.

Figure 20:
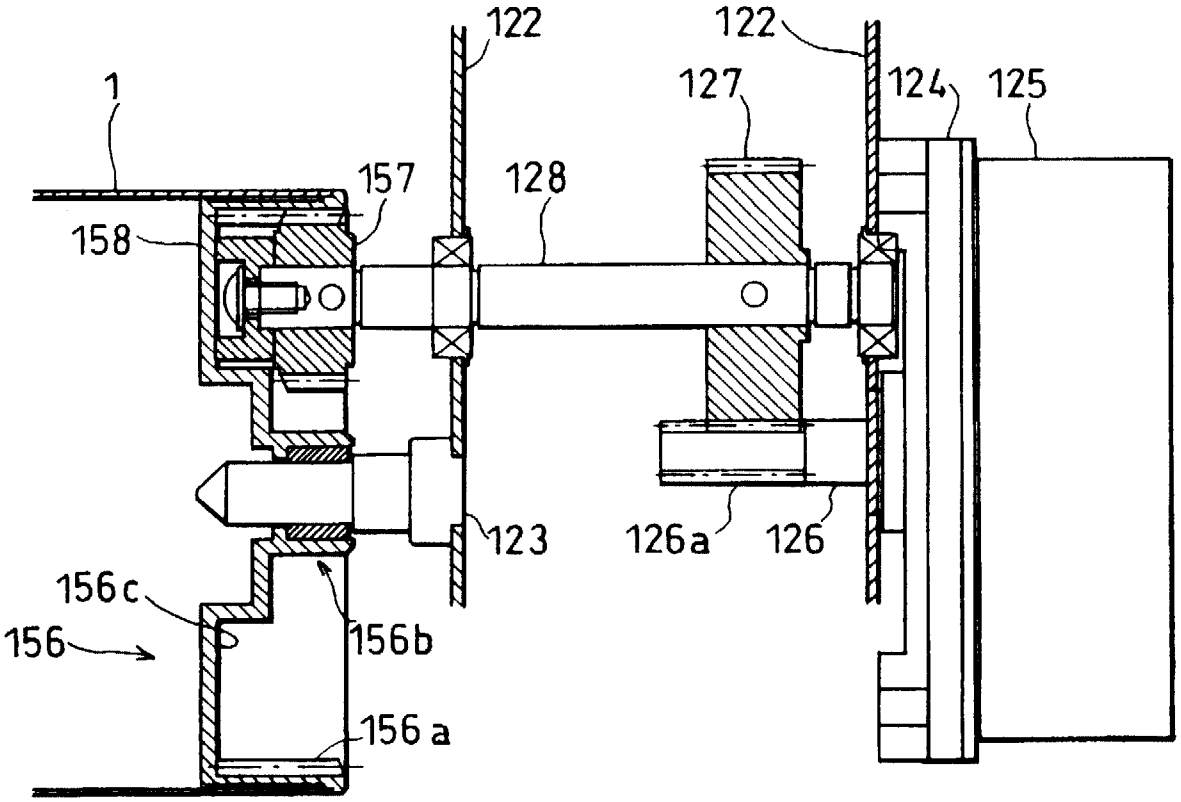
FIG. 20 is a cross-sectional view showing still another photoreceptor drum driving mechanism of the present invention.

The photoreceptor drum driving mechanism may be arranged as shown in FIG. 20. That is, a flange 156 press-fitted to one end of the photoreceptor drum 1 has a drum gear (internal drum gear) 156*a* as a helical internal gear formed along the outer circumference. The photoreceptor drum 1 is rotatably supported by the drum support shaft 123 caulked to the flame 122 and the drum support shaft (not shown) formed at the other end.

On the other hand, the drive shaft 128 which receives a drive force produced by the drive motor 125 includes a drum drive gear 157 as a helical gear in mesh with a drum gear 156*a* and the brake pad 158 (brake force application member) at the leading end thereof. The tilt of the helical teeth is set such that when the drive force is applied to the drum drive gear 157, the direction of a reaction force to be exerted to the drum drive gear 157 from the drum gear 156*a* is in the direction of the photoreceptor drum 1.

Therefore, when the drum gear 156*a* is driven by the drum drive gear 157, the brake pad 158 is pushed against a flange section 156*c* (braking surface) of the flange 156 with a constant load according to the number of rotations of the drum drive gear 157, thereby generating a brake force.

With this brake force, the teeth of the drum gear 156*a* receives a force exerted in an opposite direction to the rotating direction of the drum drive gear 157 with respect to the teeth of the drum drive gear 157. As a result, looseness caused by the backlash is eliminated, thereby preventing the fluctuation between the gears.

Figure 21:
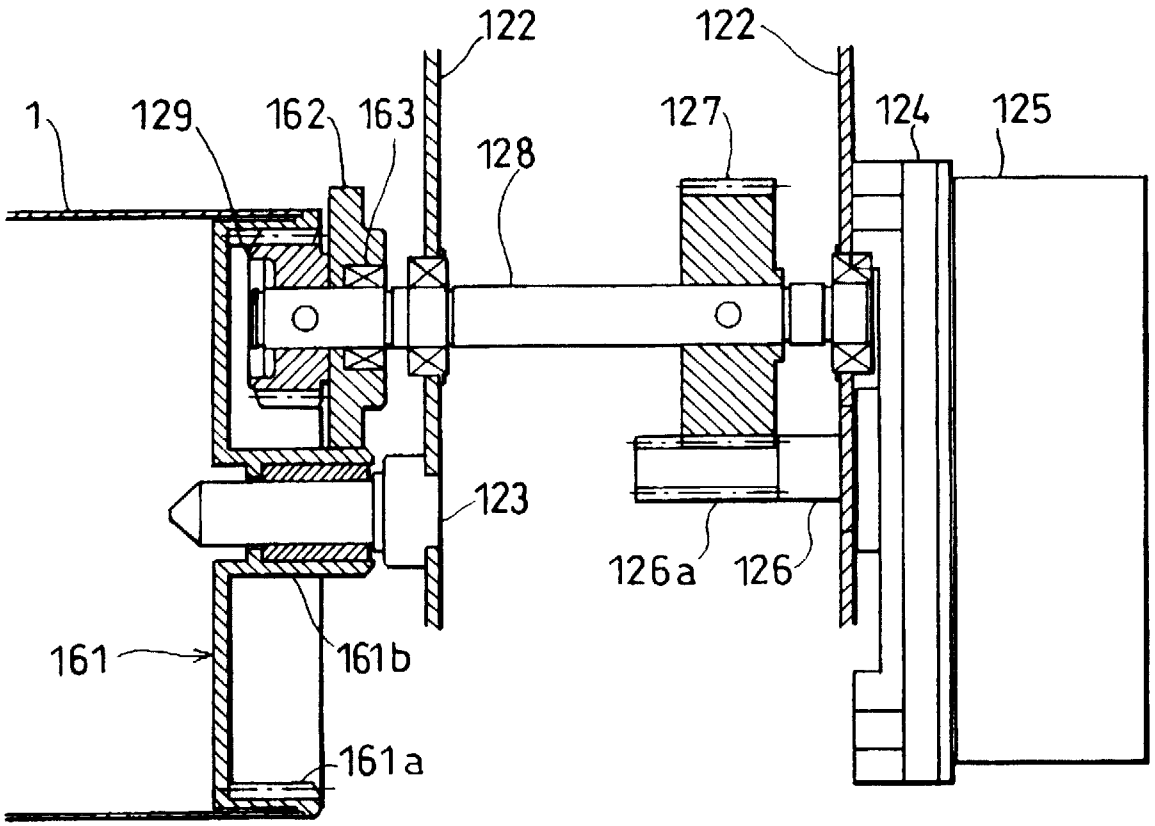
FIG. 21 is a cross-sectional view showing still another photoreceptor drum driving mechanism in accordance with the present invention.
Figure 22:
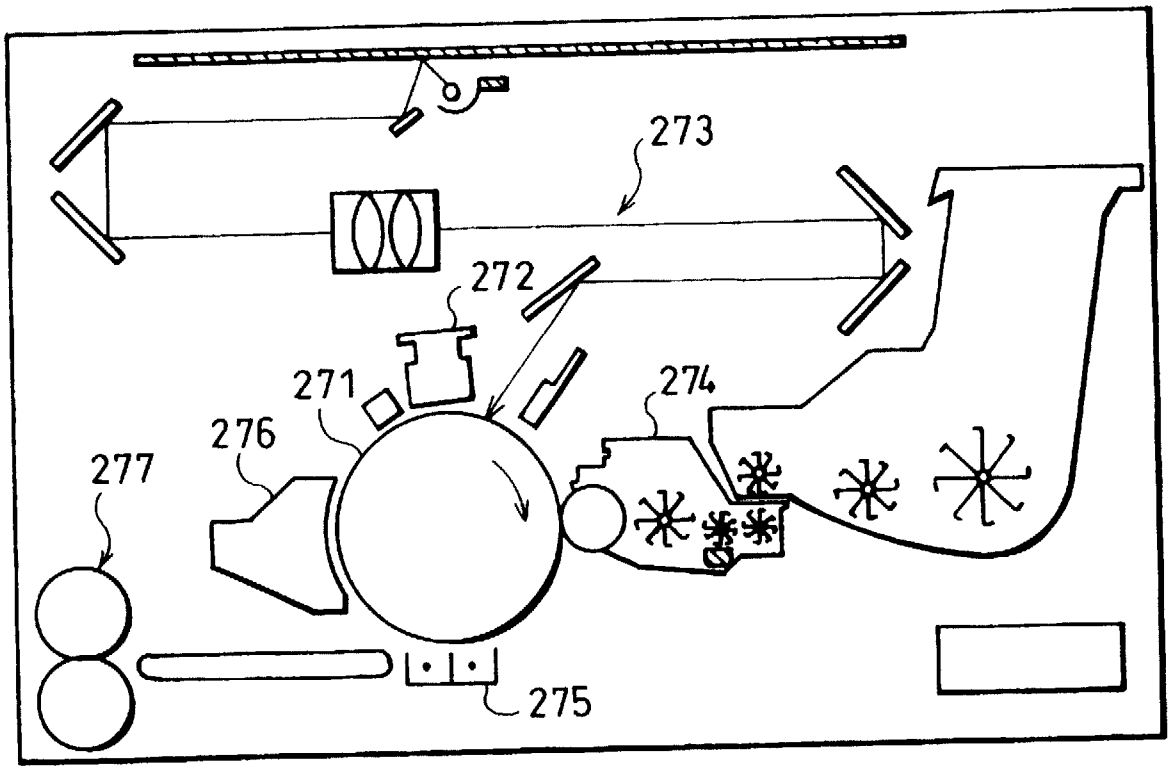
FIG. 22 is a cross-sectional view schematically showing a typical arrangement of the conventional copying machine having a cylindrical photoreceptor drum.
Figure 23B:
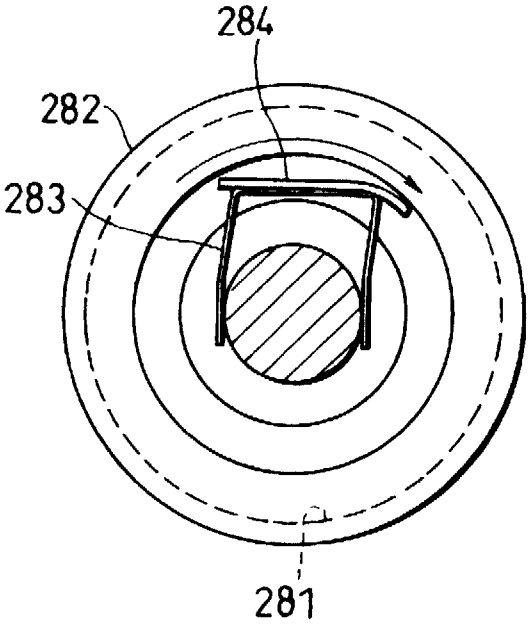
FIG. 23(*a*) is a cross-sectional view showing an arrangement of a brake mechanism of the conventional photoreceptor drum driving mechanism.
Figure 23A:
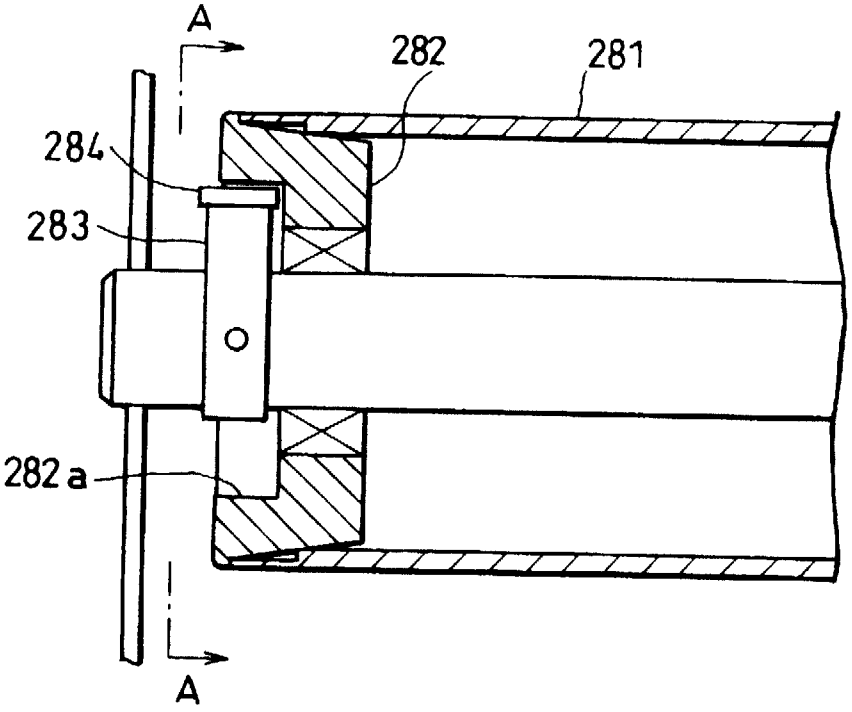
Figure 24A:
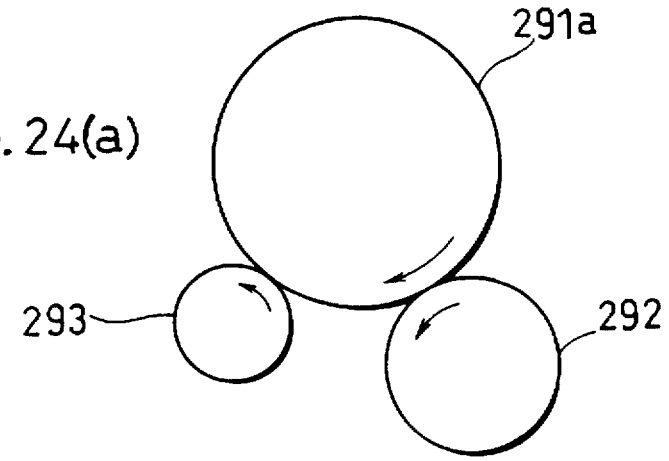
FIG. 24(i a) is an arrangement drawing showing the arrangement of the gears in the brake mechanism of the conventional photoreceptor drum driving mechanism.
Figure 24B:
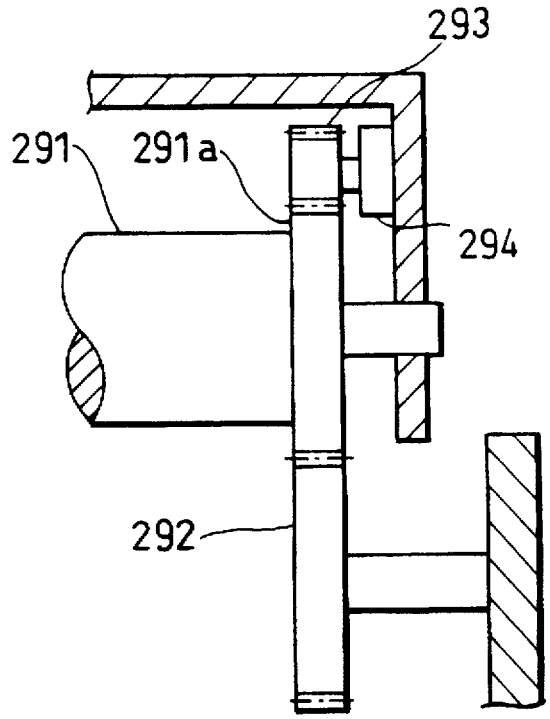

Alternately, the photoreceptor drum driving mechanism may be arranged as shown in FIG. 21. That is, a flange 161 which is press-fitted to one end of the photoreceptor drum 1 is provided with a drum gear 161*a* with the internal teeth formed along the circumference. Further, the photoreceptor drum 1 is rotatably supported by the drum support shaft 123 which is caulked to the flame 122 and a drum shaft of the other end (not shown).

On the other hand, to the drive shaft 128 which receives the drive force from the drive motor 125, mounted are a drum drive gear 129 in mesh with the drum gear 161*a* and a brake collar 162 (brake force application member) through the torque limiter 163.

The peripheral portion of the brake collar 162 is made in tight contact with the circumference of a center shaft portion 161*b* (braking surface) of the flange 161 by a reaction force generated by the engagement between the drum drive gear 129 and the drum gear 161*a*. Further, the friction force generated between the center shaft portion 161*b* and the brake collar 162 by the contact force with pressure is selected to be larger than the torque which differentiates the torque limiter 163. Therefore, when the drum drive gear 161*a* is driven by the drum drive gear 129, the brake collar 162 is pressed against the center shaft portion 161*b* of the flange 161. As a result, by a friction force generated between the center shaft portion 161*b* and the brake collar 162, the torque limiter 163 slides.

With respect to the brake collar 162, the rotations applied by the center shaft portion 161*b* has an opposite direction to the driving direction applied to the brake collar 162 from the drive shaft 128. This increases the difference in numbers of rotations of the torque limiter 163.

In the described arrangement, for example, a torque limiter of a powder clutch type represented by the powder clutch OPL series (Ogura clutch Co., Ltd.) which permits a stable load in the high speed range (around 50 to 300 rpm) may be used.

As a result, a brake force is exerted onto the photoreceptor drum 1, and the teeth of the drum gear 161*a* always receive a force in an opposite direction to the rotating direction of the drum drive gear 129 by the brake force. As this permits the looseness due to the backlash to be eliminated, the fluctuation between the gears can be prevented.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the instant contribution to the art and, therefore, such adaptations should and are intended to be comprehended within the meaning and range of equivalence of the appended claims.

What is claimed is:

1. A photoreceptor drum driving mechanism, comprising:

a photoreceptor drum provided with an internal drum gear;

a drum drive gear supported by an overhang shaft, said drum drive gear being in mesh with said internal drum gear;

a driving unit for driving said photoreceptor drum by rotating said drum drive gear; and a roller coaxially formed with a rotation shaft of said drum drive gear, said roller having a curved surface being in contact with a rolling curved surface formed in a concentric circle with a rotation shaft of said photoreceptor drum, so as to constantly maintain relative position of said drum drive gear to the rotation shaft of said photoreceptor drum.

2. The photoreceptor drum driving mechanism as set forth in claim 1, further comprising:

a main frame for supporting said photoreceptor drum, said main frame having an opening with a size that allows said roller and said drum drive gear to pass therethrough.

3. The photoreceptor drum driving mechanism as set forth in claim 1, wherein:

said roller is formed at a leading end of the rotation shaft of said drum drive gear.

4. The photoreceptor drum driving mechanism as set forth in claim 1, further comprising:

a drive frame for supporting the rotation shaft of said drum drive gear via a bearing, wherein when three or more bearings are provided for the rotation shaft of said drum drive gear, a clearance for engagement between said drive frame and the bearing of said drive frame is selected to be substantially in a range of from 0.1 mm to 0.2 mm.

5. The photoreceptor drum driving mechanism as set forth in claim 1, further comprising:

a bearing for the rotation shaft of said drum drive gear, wherein said bearing is a radial roller bearing.

6. A photoreceptor drum driving mechanism, comprising:

a photoreceptor drum provided with an internal drum gear;

a drum drive gear coaxially formed with a rotation shaft of said photoreceptor drum;

a plurality of intermediate gears, one side of each being supported, said intermediate gears being provided at equal intervals around said drum drive gear, said intermediate gears being in mesh with said internal drum gear and said drum drive gear; and a drive unit for driving said photoreceptor drum by rotating said drum drive gear.

7. The photoreceptor drum driving mechanism as set forth in claim 6, wherein:

three intermediate gears are provided as said plurality of intermediate gears.

8. The photoreceptor drum driving mechanism as set forth in claim 6, further comprising:

a roller being externally in contact with a rolling surface formed on an inner circumference of said photoreceptor drum, said roller being coaxially formed with said plurality of intermediate gears.

9. The photoreceptor drum driving mechanism as set forth in claim 6, further comprising:

a bearing for a rotation shaft of said drum drive gear, wherein said bearing is a radial roller bearing.

10. A photoreceptor drum driving mechanism, comprising:

a photoreceptor drum provided with a drum gear unit;

a drum drive gear in mesh with said drum gear unit;

a drive unit for driving said photoreceptor drum by rotating said drum drive gear; and a brake gear in mesh with said drum gear unit, for controlling play between said drum gear unit and said drum drive gear by applying a brake force on said photoreceptor drum, said brake gear being provided on a rotation shaft of said brake gear via a torque limiter, wherein a combination of gears and a gear ratio are set in such a manner that a number of rotations of said brake gear being transmitted from said drum gear unit to said brake gear is different from a number of rotations being transmitted from said drum drive gear to said torque limiter via the rotation shaft of said brake gear.

11. The photoreceptor drum driving mechanism as set forth in claim 10, wherein:

said torque limiter is of a spring clutch type.

12. The photoreceptor drum driving mechanism as set forth in claim 10, wherein:

said drum gear unit is an internal drum gear, and said drum drive gear and said brake gear are disposed inside said photoreceptor drum.

13. The photoreceptor drum driving mechanism as set forth in claim 10, wherein:

said brake gear shares the rotation shaft thereof with said drum drive gear.

14. The photoreceptor drum driving mechanism as set forth in claim 10, satisfying:

$m_1 \times z_1 > m_2 \times Z_2$, wherein $m_1$, is a module of said drum drive gear, $z_1$ is a number of teeth of said drum drive gear, $m_2$ is a module of said brake gear, and $z_2$ is a number of teeth of said brake gear.

15. The photoreceptor drum driving mechanism as set forth in claim 14, wherein:

said torque limiter is a spring clutch.

16. The photoreceptor drum driving mechanism as set forth in claim 14, wherein:

said drum drive gear and said brake gear satisfy $m_1(z_1-2.5) \leqq m_2 (Z_2+2)$.

17. The photoreceptor drum driving mechanism as set forth in claim 13, wherein:

said drum gear unit is an external drum gear, and the rotation shaft is provided outside said photoreceptor drum.

18. The photoreceptor drum driving mechanism as set forth in claim 10, wherein:

said drum gear unit includes an internal drum gear in mesh with said drum drive gear and an external brake drum gear in mesh with said brake gear.

19. The photoreceptor drum driving mechanism as set forth in claim 18, wherein:

said torque limiter is a powder clutch.

20. A photoreceptor drum driving mechanism, comprising:

a photoreceptor drum provided with an internal drum gear and a braking surface;

a drum drive gear in mesh with said internal drum gear;

a drive unit for driving said photoreceptor drum by rotating said drum drive gear; and a brake force application member in contact with said braking surface by a reaction force exerted between said internal drum gear and said drum drive gear when driving, said brake force application member being provided on a drive shaft of said drum drive gear.

21. The photoreceptor drum driving mechanism as set forth in claim 20, further comprising:

a torque limiter having a differential toque which is smaller than a friction force exerted between said brake force application member and said braking surface by the reaction force, wherein said braking surface is circularly formed so as to integrally rotate with said photoreceptor drum around a bearing of said photoreceptor drum, said brake force application member is formed in a concentric circle with the drive shaft of said drum drive gear via said torque limiter, and a circumferential portion of said brake force application member is in contact with the braking surface.

22. The photoreceptor drum driving mechanism as set forth in claim 21, wherein: said torque limiter is a powder clutch.

* * * * *